US008590325B2

(12) United States Patent
Pham

(10) Patent No.: US 8,590,325 B2
(45) Date of Patent: Nov. 26, 2013

(54) PROTECTION AND DIAGNOSTIC MODULE FOR A REFRIGERATION SYSTEM

(75) Inventor: Hung M. Pham, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 1262 days.

(21) Appl. No.: 11/776,879

(22) Filed: Jul. 12, 2007

(65) Prior Publication Data

US 2008/0209925 A1 Sep. 4, 2008

Related U.S. Application Data

(60) Provisional application No. 60/831,755, filed on Jul. 19, 2006.

(51) Int. Cl.
*G01K 13/00* (2006.01)
*F25B 49/00* (2006.01)

(52) U.S. Cl.
USPC ..... 62/129; 62/126; 62/127

(58) Field of Classification Search
USPC ..... 62/126, 127, 129, 149, 208, 498
See application file for complete search history.

(56) References Cited

U.S. PATENT DOCUMENTS

| | | | |
|---|---|---|---|
| 2,054,542 | A | 9/1936 | Hoelle |
| 2,978,879 | A | 4/1961 | Heidorn |
| 3,047,696 | A | 7/1962 | Heidorn |
| 3,107,843 | A | 10/1963 | Finn |
| 3,170,304 | A | 2/1965 | Hale |
| 3,232,519 | A | 2/1966 | Long |
| 3,278,111 | A | 10/1966 | Parker |
| 3,339,164 | A | 8/1967 | Landis et al. |
| 3,665,339 | A | 5/1972 | Liu |
| 3,665,399 | A | 5/1972 | Zehr et al. |
| 3,729,949 | A | 5/1973 | Talbot |
| 3,735,377 | A | 5/1973 | Kaufman |
| 3,742,303 | A | 6/1973 | Dageford |
| 3,783,681 | A | 1/1974 | Hirt et al. |
| 3,927,712 | A | 12/1975 | Nakayama |
| 3,935,519 | A | 1/1976 | Pfarrer et al. |
| 3,950,962 | A | 4/1976 | Odashima |
| 3,960,011 | A | 6/1976 | Renz et al. |

(Continued)

FOREIGN PATENT DOCUMENTS

| | | | |
|---|---|---|---|
| CN | 1133425 | A | 10/1996 |
| CN | 1297522 | A | 5/2001 |

(Continued)

OTHER PUBLICATIONS

The International Search Report regarding International Application No. PCT/US2007/019563, Jan. 15, 2008.

(Continued)

*Primary Examiner* — Chen Wen Jiang
(74) *Attorney, Agent, or Firm* — Harness, Dickey & Pierce, P.L.C.

(57) ABSTRACT

A system includes a compressor and a compressor motor functioning in a refrigeration circuit. A sensor produces a signal indicative of one of current and power drawn by the motor and a liquid-line temperature sensor provides a signal indicative of a temperature of liquid circulating within the refrigeration circuit. Processing circuitry processes the current or power signal to determine a condenser temperature of the refrigeration circuit and a subcooling value of the refrigeration circuit from the condenser temperature and the liquid-line temperature signal.

22 Claims, 17 Drawing Sheets

(56) References Cited

U.S. PATENT DOCUMENTS

| | | | |
|---|---|---|---|
| 3,978,382 | A | 8/1976 | Pfarrer et al. |
| 3,998,068 | A | 12/1976 | Chirnside |
| 4,014,182 | A | 3/1977 | Granryd |
| 4,018,584 | A | 4/1977 | Mullen |
| 4,024,725 | A | 5/1977 | Uchida et al. |
| 4,034,570 | A | 7/1977 | Anderson et al. |
| 4,038,061 | A | 7/1977 | Anderson et al. |
| 4,046,532 | A | 9/1977 | Nelson |
| 4,060,716 | A | 11/1977 | Pekrul et al. |
| 4,066,869 | A | 1/1978 | Apaloo et al. |
| 4,090,248 | A | 5/1978 | Swanson et al. |
| 4,102,394 | A | 7/1978 | Botts |
| 4,104,888 | A | 8/1978 | Reedy et al. |
| 4,105,063 | A | 8/1978 | Bergt |
| 4,112,703 | A | 9/1978 | Kountz |
| 4,136,730 | A | 1/1979 | Kinsey |
| 4,137,057 | A | 1/1979 | Piet et al. |
| 4,137,725 | A | 2/1979 | Martin |
| 4,142,375 | A | 3/1979 | Abe et al. |
| 4,143,707 | A | 3/1979 | Lewis et al. |
| 4,146,085 | A | 3/1979 | Wills |
| RE29,966 | E | 4/1979 | Nussbaum |
| 4,156,350 | A | 5/1979 | Elliott et al. |
| 4,161,106 | A | 7/1979 | Savage et al. |
| 4,165,619 | A | 8/1979 | Girard |
| 4,171,622 | A | 10/1979 | Yamaguchi et al. |
| 4,173,871 | A | 11/1979 | Brooks |
| RE30,242 | E | 4/1980 | del Toro et al. |
| 4,209,994 | A | 7/1980 | Mueller et al. |
| 4,211,089 | A | 7/1980 | Mueller et al. |
| 4,220,010 | A | 9/1980 | Mueller et al. |
| 4,227,862 | A | 10/1980 | Andrew et al. |
| 4,232,530 | A | 11/1980 | Mueller |
| 4,233,818 | A | 11/1980 | Lastinger |
| 4,236,379 | A | 12/1980 | Mueller |
| 4,244,182 | A | 1/1981 | Behr |
| 4,246,763 | A | 1/1981 | Mueller et al. |
| 4,248,051 | A | 2/1981 | Darcy et al. |
| 4,251,988 | A | 2/1981 | Allard et al. |
| 4,257,795 | A | 3/1981 | Shaw |
| 4,259,847 | A | 4/1981 | Pearse, Jr. |
| 4,267,702 | A | 5/1981 | Houk |
| 4,271,898 | A | 6/1981 | Freeman |
| 4,286,438 | A | 9/1981 | Clarke |
| 4,290,480 | A | 9/1981 | Sulkowski |
| 4,301,660 | A | 11/1981 | Mueller et al. |
| 4,307,775 | A | 12/1981 | Saunders |
| 4,311,188 | A | 1/1982 | Kojima et al. |
| 4,319,461 | A | 3/1982 | Shaw |
| 4,325,223 | A | 4/1982 | Cantley |
| 4,328,678 | A | 5/1982 | Kono et al. |
| 4,328,680 | A | 5/1982 | Stamp, Jr. et al. |
| 4,333,316 | A | 6/1982 | Stamp et al. |
| 4,333,317 | A | 6/1982 | Sawyer |
| 4,336,001 | A | 6/1982 | Andrew et al. |
| 4,338,790 | A | 7/1982 | Saunders et al. |
| 4,338,791 | A | 7/1982 | Stamp et al. |
| 4,345,162 | A | 8/1982 | Hammer et al. |
| 4,350,021 | A | 9/1982 | Lundstrom |
| 4,350,023 | A | 9/1982 | Kuwabara et al. |
| 4,356,703 | A | 11/1982 | Vogel |
| 4,361,273 | A | 11/1982 | Levine et al. |
| 4,365,983 | A | 12/1982 | Abraham et al. |
| 4,370,098 | A | 1/1983 | McClain et al. |
| 4,372,119 | A | 2/1983 | Gillbrand et al. |
| 4,376,926 | A | 3/1983 | Senor |
| 4,381,549 | A | 4/1983 | Stamp, Jr. et al. |
| 4,382,367 | A | 5/1983 | Roberts |
| 4,384,462 | A | 5/1983 | Overman et al. |
| 4,387,368 | A | 6/1983 | Day et al. |
| 4,390,321 | A | 6/1983 | Langlois et al. |
| 4,390,922 | A | 6/1983 | Pelliccia |
| 4,395,886 | A | 8/1983 | Mayer |
| 4,395,887 | A | 8/1983 | Sweetman |
| 4,399,548 | A | 8/1983 | Castleberry |
| 4,406,133 | A | 9/1983 | Saunders et al. |
| 4,407,138 | A | 10/1983 | Mueller |
| 4,408,660 | A | 10/1983 | Sutoh et al. |
| 4,425,010 | A | 1/1984 | Bryant et al. |
| 4,429,578 | A | 2/1984 | Darrel et al. |
| 4,441,329 | A | 4/1984 | Dawley |
| 4,448,038 | A | 5/1984 | Barbier |
| 4,449,375 | A | 5/1984 | Briccetti |
| 4,460,123 | A | 7/1984 | Beverly |
| 4,463,571 | A | 8/1984 | Wiggs |
| 4,465,229 | A | 8/1984 | Kompelien |
| 4,467,230 | A | 8/1984 | Rovinsky |
| 4,467,385 | A | 8/1984 | Bandoli et al. |
| 4,467,613 | A | 8/1984 | Behr et al. |
| 4,470,092 | A | 9/1984 | Lombardi |
| 4,470,266 | A | 9/1984 | Briccetti et al. |
| 4,474,024 | A | 10/1984 | Eplett et al. |
| 4,479,389 | A | 10/1984 | Anderson, III et al. |
| 4,489,551 | A | 12/1984 | Watanabe et al. |
| 4,495,779 | A | 1/1985 | Tanaka et al. |
| 4,496,296 | A | 1/1985 | Arai et al. |
| 4,497,031 | A | 1/1985 | Froehling et al. |
| 4,498,310 | A | 2/1985 | Imanishi et al. |
| 4,499,739 | A | 2/1985 | Matsuoka et al. |
| 4,502,084 | A | 2/1985 | Hannett |
| 4,502,833 | A | 3/1985 | Hibino et al. |
| 4,502,842 | A | 3/1985 | Currier et al. |
| 4,502,843 | A | 3/1985 | Martin |
| 4,506,518 | A | 3/1985 | Yoshikawa et al. |
| 4,507,934 | A | 4/1985 | Tanaka et al. |
| 4,510,547 | A | 4/1985 | Rudich, Jr. |
| 4,510,576 | A | 4/1985 | MacArthur et al. |
| 4,512,161 | A | 4/1985 | Logan et al. |
| 4,516,407 | A | 5/1985 | Watabe |
| 4,520,674 | A | 6/1985 | Canada et al. |
| 4,523,435 | A | 6/1985 | Lord |
| 4,523,436 | A | 6/1985 | Schedel et al. |
| 4,527,399 | A | 7/1985 | Lord |
| 4,535,607 | A | 8/1985 | Mount |
| 4,538,420 | A | 9/1985 | Nelson |
| 4,538,422 | A | 9/1985 | Mount et al. |
| 4,539,820 | A | 9/1985 | Zinsmeyer |
| 4,545,210 | A | 10/1985 | Lord |
| 4,545,214 | A | 10/1985 | Kinoshita |
| 4,548,549 | A | 10/1985 | Murphy et al. |
| 4,549,403 | A | 10/1985 | Lord et al. |
| 4,549,404 | A | 10/1985 | Lord |
| 4,555,057 | A | 11/1985 | Foster |
| 4,557,317 | A | 12/1985 | Harmon, Jr. |
| 4,561,260 | A | 12/1985 | Nishi et al. |
| 4,563,624 | A | 1/1986 | Yu |
| 4,563,877 | A | 1/1986 | Harnish |
| 4,574,871 | A | 3/1986 | Parkinson et al. |
| 4,580,947 | A | 4/1986 | Shibata et al. |
| 4,583,373 | A | 4/1986 | Shaw |
| 4,589,060 | A | 5/1986 | Zinsmeyer |
| 4,598,764 | A | 7/1986 | Beckey |
| 4,602,484 | A | 7/1986 | Bendikson |
| 4,611,470 | A | 9/1986 | Enstrom |
| 4,612,775 | A | 9/1986 | Branz et al. |
| 4,614,089 | A | 9/1986 | Dorsey |
| 4,617,804 | A | 10/1986 | Fukushima et al. |
| 4,620,424 | A | 11/1986 | Tanaka et al. |
| 4,621,502 | A | 11/1986 | Ibrahim et al. |
| 4,627,245 | A | 12/1986 | Levine |
| 4,627,483 | A | 12/1986 | Harshbarger et al. |
| 4,627,484 | A | 12/1986 | Harshbarger, Jr. et al. |
| 4,630,670 | A | 12/1986 | Wellman et al. |
| 4,642,034 | A | 2/1987 | Terauchi |
| 4,646,532 | A | 3/1987 | Nose |
| 4,649,710 | A | 3/1987 | Inoue et al. |
| 4,653,280 | A | 3/1987 | Hansen et al. |
| 4,653,285 | A | 3/1987 | Pohl |
| 4,655,688 | A | 4/1987 | Bohn et al. |
| 4,660,386 | A | 4/1987 | Hansen et al. |
| 4,662,184 | A | 5/1987 | Pohl et al. |
| 4,674,292 | A | 6/1987 | Ohya et al. |
| 4,677,830 | A | 7/1987 | Sumikawa et al. |
| 4,680,940 | A | 7/1987 | Vaughn |

(56) References Cited

U.S. PATENT DOCUMENTS 4,682,473 A 7/1987 Rogers
4,684,060 A 8/1987 Adams et al.
4,686,835 A 8/1987 Alsenz
4,689,967 A 9/1987 Han et al.
4,697,431 A 10/1987 Alsenz
4,698,978 A 10/1987 Jones
4,698,981 A 10/1987 Kaneko et al.
4,701,824 A 10/1987 Beggs et al.
4,706,152 A 11/1987 DeFilippis et al.
4,706,469 A 11/1987 Oguni et al.
4,712,648 A 12/1987 Mattes et al.
4,713,717 A 12/1987 Pejouhy et al.
4,715,190 A 12/1987 Han et al.
4,720,980 A 1/1988 Howland
4,735,054 A 4/1988 Beckey
4,735,060 A 4/1988 Alsenz
4,744,223 A 5/1988 Umezu
4,745,765 A 5/1988 Pettitt
4,745,766 A 5/1988 Bahr
4,745,767 A 5/1988 Ohya et al.
4,750,332 A 6/1988 Jenski et al.
4,750,672 A 6/1988 Beckey et al.
4,751,825 A 6/1988 Voorhis et al.
4,755,957 A 7/1988 White et al.
4,765,150 A 8/1988 Persem
4,768,348 A 9/1988 Noguchi
4,790,142 A 12/1988 Beckey
4,798,055 A 1/1989 Murray et al.
4,805,118 A 2/1989 Rishel
4,807,445 A 2/1989 Matsuoka et al.
4,820,130 A 4/1989 Eber et al.
4,829,779 A 5/1989 Munson et al.
4,831,560 A 5/1989 Zaleski
4,835,980 A 6/1989 Oyanagi et al.
4,841,734 A 6/1989 Torrence
4,845,956 A 7/1989 Berntsen et al.
4,848,099 A 7/1989 Beckey et al.
4,848,100 A 7/1989 Barthel et al.
4,850,198 A 7/1989 Helt et al.
4,850,204 A 7/1989 Bos et al.
4,852,363 A 8/1989 Kampf et al.
4,856,286 A 8/1989 Sulfstede et al.
4,858,676 A 8/1989 Bolfik et al.
4,866,944 A 9/1989 Yamazaki
4,869,073 A 9/1989 Kawai et al.
4,873,836 A 10/1989 Thompson
4,877,382 A 10/1989 Caillat et al.
4,878,355 A 11/1989 Beckey et al.
4,881,184 A 11/1989 Abegg, III et al.
4,882,908 A 11/1989 White
4,884,412 A 12/1989 Sellers et al.
4,885,707 A 12/1989 Nichol et al.
4,885,914 A 12/1989 Pearman
4,887,436 A 12/1989 Enomoto et al.
4,887,857 A 12/1989 VanOmmeren
4,889,280 A 12/1989 Grald et al.
4,893,480 A 1/1990 Matsui et al.
4,899,551 A 2/1990 Weintraub
4,903,500 A 2/1990 Hanson
4,909,041 A 3/1990 Jones
4,909,076 A 3/1990 Busch et al.
4,910,966 A 3/1990 Levine et al.
4,913,625 A 4/1990 Gerlowski
4,916,912 A 4/1990 Levine et al.
4,918,932 A 4/1990 Gustafson et al.
4,932,588 A 6/1990 Fedter et al.
4,939,909 A 7/1990 Tsuchiyama et al.
4,943,003 A 7/1990 Shimizu et al.
4,944,160 A 7/1990 Malone et al.
4,945,491 A 7/1990 Rishel
4,953,784 A 9/1990 Yasufuku et al.
4,959,970 A 10/1990 Meckler
4,964,060 A 10/1990 Hartsog
4,966,006 A 10/1990 Thuesen et al.
4,967,567 A 11/1990 Proctor et al.
4,970,496 A 11/1990 Kirkpatrick
4,974,665 A 12/1990 Zillner, Jr.
4,975,024 A 12/1990 Heckel
4,977,751 A 12/1990 Hanson
4,985,857 A 1/1991 Bajpai et al.
4,987,748 A 1/1991 Meckler
4,990,057 A 2/1991 Rollins
4,991,770 A 2/1991 Bird et al.
5,000,009 A 3/1991 Clanin
5,009,075 A 4/1991 Okoren
5,009,076 A 4/1991 Winslow
5,012,629 A 5/1991 Rehman et al.
5,018,665 A 5/1991 Sulmone
RE33,620 E 6/1991 Persem
5,042,264 A 8/1991 Dudley
5,056,036 A 10/1991 Van Bork
5,056,329 A 10/1991 Wilkinson
5,058,388 A 10/1991 Shaw et al.
5,062,278 A 11/1991 Sugiyama
5,065,593 A 11/1991 Dudley et al.
RE33,775 E 12/1991 Behr et al.
5,071,065 A 12/1991 Aalto et al.
5,073,091 A 12/1991 Burgess et al.
5,073,862 A 12/1991 Carlson
5,076,067 A 12/1991 Prenger et al.
5,076,494 A 12/1991 Ripka
5,077,983 A 1/1992 Dudley
5,094,086 A 3/1992 Shyu
5,095,712 A 3/1992 Narreau
5,095,715 A 3/1992 Dudley
5,102,316 A 4/1992 Caillat et al.
5,103,391 A 4/1992 Barrett
5,109,676 A 5/1992 Waters et al.
5,109,700 A 5/1992 Hicho
5,115,406 A 5/1992 Zatezalo et al.
5,115,643 A 5/1992 Hayata
5,115,644 A 5/1992 Alsenz
5,118,260 A 6/1992 Fraser, Jr.
5,119,466 A 6/1992 Suzuki
5,119,637 A 6/1992 Bard et al.
5,121,610 A 6/1992 Atkinson et al.
5,123,252 A 6/1992 Hanson
5,123,253 A 6/1992 Hanson et al.
5,123,255 A 6/1992 Ohizumi
RE34,001 E 7/1992 Wrobel
5,141,407 A 8/1992 Ramsey et al.
5,142,877 A 9/1992 Shimizu
5,167,494 A 12/1992 Inagaki et al.
5,170,935 A 12/1992 Federspiel et al.
5,170,936 A 12/1992 Kubo et al.
5,186,014 A 2/1993 Runk
5,199,855 A 4/1993 Nakajima et al.
5,200,872 A 4/1993 D'Entremont et al.
5,201,862 A 4/1993 Pettitt
5,203,178 A 4/1993 Shyu
5,209,076 A 5/1993 Kauffman et al.
5,209,400 A 5/1993 Winslow et al.
5,219,041 A 6/1993 Greve
5,224,354 A * 7/1993 Ito et al. ..... 62/210
5,224,835 A 7/1993 Oltman
5,228,300 A 7/1993 Shim
5,228,307 A 7/1993 Koce
5,231,844 A 8/1993 Park
5,233,841 A 8/1993 Jyrek
5,237,830 A 8/1993 Grant
5,241,833 A 9/1993 Ohkoshi
5,243,829 A 9/1993 Bessler
5,248,244 A 9/1993 Ho et al.
5,251,454 A 10/1993 Yoon
5,257,506 A 11/1993 DeWolf et al.
5,271,556 A 12/1993 Helt et al.
5,276,630 A 1/1994 Baldwin et al.
5,279,458 A 1/1994 DeWolf et al.
5,290,154 A 3/1994 Kotlarek et al.
5,291,752 A 3/1994 Alvarez et al.
5,299,504 A 4/1994 Abele
5,303,560 A 4/1994 Hanson et al.
5,311,451 A 5/1994 Barrett
5,320,506 A 6/1994 Fogt

(56) References Cited

U.S. PATENT DOCUMENTS 5,333,460 A 8/1994 Lewis et al.
5,335,507 A 8/1994 Powell
5,336,058 A 8/1994 Yokoyama
5,362,206 A 11/1994 Westerman et al.
5,362,211 A 11/1994 Iizuka et al.
5,368,446 A 11/1994 Rode
5,381,669 A 1/1995 Bahel et al.
5,381,692 A 1/1995 Winslow et al.
5,416,781 A 5/1995 Ruiz
5,423,190 A 6/1995 Friedland
5,423,192 A 6/1995 Young et al.
5,435,148 A 7/1995 Sandofsky et al.
5,440,890 A 8/1995 Bahel et al.
5,440,895 A 8/1995 Bahel et al.
5,446,677 A 8/1995 Jensen et al.
5,454,229 A 10/1995 Hanson et al.
5,460,006 A 10/1995 Torimitsu
5,475,986 A 12/1995 Bahel et al.
5,481,481 A 1/1996 Frey et al.
5,499,512 A 3/1996 Jurewicz et al.
5,509,786 A 4/1996 Mizutani et al.
5,511,387 A 4/1996 Tinsler
5,528,908 A 6/1996 Bahel et al.
5,532,534 A 7/1996 Baker et al.
5,533,347 A 7/1996 Ott et al.
5,535,597 A 7/1996 An
5,546,015 A 8/1996 Okabe
5,548,966 A 8/1996 Tinsler
5,562,426 A 10/1996 Watanabe et al.
5,579,648 A 12/1996 Hanson et al.
5,586,445 A 12/1996 Bessler
5,592,824 A 1/1997 Sogabe et al.
5,596,507 A 1/1997 Jones et al.
5,602,757 A 2/1997 Haseley et al.
5,610,339 A 3/1997 Haseley et al.
5,611,674 A 3/1997 Bass et al.
5,613,841 A 3/1997 Bass et al.
5,615,071 A 3/1997 Higashikata et al.
5,616,829 A 4/1997 Balaschak et al.
5,623,834 A 4/1997 Bahel et al.
5,628,201 A 5/1997 Bahel et al.
5,630,325 A 5/1997 Bahel et al.
5,641,270 A 6/1997 Sgourakes et al.
5,655,379 A 8/1997 Jaster et al.
5,656,767 A 8/1997 Garvey, III et al.
5,689,963 A 11/1997 Bahel et al.
5,691,692 A 11/1997 Herbstritt
5,699,670 A 12/1997 Jurewicz et al.
5,707,210 A 1/1998 Ramsey et al.
5,713,724 A 2/1998 Centers et al.
5,737,931 A 4/1998 Ueno et al.
5,741,120 A 4/1998 Bass et al.
5,754,450 A 5/1998 Solomon et al.
5,772,403 A 6/1998 Allison et al.
5,795,381 A 8/1998 Holder
5,798,941 A 8/1998 McLeister
5,802,860 A * 9/1998 Barrows ..... 62/126
5,807,336 A 9/1998 Russo et al.
5,808,441 A 9/1998 Nehring
5,857,348 A 1/1999 Conry
5,869,960 A 2/1999 Brand
5,875,638 A 3/1999 Tinsler
5,884,494 A 3/1999 Okoren et al.
5,924,295 A 7/1999 Park
5,947,701 A 9/1999 Hugenroth
5,950,443 A 9/1999 Meyer et al.
5,956,658 A 9/1999 McMahon
5,971,712 A 10/1999 Kann
5,975,854 A 11/1999 Culp, III et al.
5,984,645 A 11/1999 Cummings
5,987,903 A 11/1999 Bathla
5,988,986 A 11/1999 Brinken et al.
5,995,347 A 11/1999 Rudd et al.
5,995,351 A 11/1999 Katsumata et al.
6,017,192 A 1/2000 Clack et al.
6,020,702 A 2/2000 Farr
6,023,420 A 2/2000 McCormick et al.
6,035,653 A 3/2000 Itoh et al.
6,035,661 A 3/2000 Sunaga et al.
6,041,605 A 3/2000 Heinrichs
6,041,609 A 3/2000 Hornsleth et al.
6,042,344 A 3/2000 Lifson
6,047,557 A 4/2000 Pham et al.
6,050,780 A 4/2000 Hasegawa et al.
6,057,771 A 5/2000 Lakra
6,065,946 A 5/2000 Lathrop
6,068,447 A 5/2000 Foege
6,077,051 A 6/2000 Centers et al.
6,081,750 A 6/2000 Hoffberg et al.
6,082,495 A 7/2000 Steinbarger et al.
6,082,971 A 7/2000 Gunn et al.
6,085,530 A 7/2000 Barito
6,092,370 A 7/2000 Tremoulet, Jr. et al.
6,092,378 A 7/2000 Das et al.
6,092,992 A 7/2000 Imblum et al.
6,102,665 A 8/2000 Centers et al.
6,125,642 A 10/2000 Seener et al.
6,128,583 A 10/2000 Dowling
6,129,527 A 10/2000 Donahoe et al.
6,157,310 A 12/2000 Milne et al.
6,158,230 A 12/2000 Katsuki
6,174,136 B1 1/2001 Kilayko et al.
6,176,686 B1 1/2001 Wallis et al.
6,179,214 B1 1/2001 Key et al.
6,181,033 B1 1/2001 Wright
6,199,018 B1 3/2001 Quist et al.
6,260,004 B1 7/2001 Hays et al.
6,276,901 B1 8/2001 Farr et al.
6,279,332 B1 8/2001 Yeo et al.
6,302,654 B1 10/2001 Millet et al.
6,324,854 B1 12/2001 Jayanth
6,332,327 B1 12/2001 Street et al.
6,360,551 B1 3/2002 Renders
6,375,439 B1 4/2002 Missio
6,381,971 B2 5/2002 Honda
6,390,779 B1 5/2002 Cunkelman
6,406,265 B1 6/2002 Hahn et al.
6,406,266 B1 6/2002 Hugenroth et al.
6,412,293 B1 7/2002 Pham et al.
6,438,981 B1 8/2002 Whiteside
6,442,953 B1 9/2002 Trigiani et al.
6,449,972 B2 9/2002 Pham et al.
6,450,771 B1 9/2002 Centers et al.
6,453,687 B2 9/2002 Sharood et al.
6,454,538 B1 9/2002 Witham et al.
6,457,319 B1 10/2002 Ota et al.
6,457,948 B1 10/2002 Pham
6,467,280 B2 10/2002 Pham et al.
6,471,486 B1 10/2002 Centers et al.
6,484,520 B2 11/2002 Kawaguchi et al.
6,487,457 B1 11/2002 Hull et al.
6,492,923 B1 12/2002 Inoue et al.
6,497,554 B2 12/2002 Yang et al.
6,501,240 B2 12/2002 Ueda et al.
6,501,629 B1 12/2002 Marriott
6,502,409 B1 1/2003 Gatling et al.
6,505,475 B1 1/2003 Zugibe et al.
6,529,590 B1 3/2003 Centers
6,533,552 B2 3/2003 Centers et al.
6,537,034 B2 3/2003 Park et al.
6,542,062 B1 4/2003 Herrick
6,558,126 B1 5/2003 Hahn et al.
6,560,976 B2 5/2003 Jayanth
6,571,566 B1 6/2003 Temple et al.
6,571,586 B1 6/2003 Ritson et al.
6,589,029 B1 7/2003 Heller
6,595,757 B2 7/2003 Shen
6,601,397 B2 8/2003 Pham et al.
6,615,594 B2 9/2003 Jayanth et al.
6,616,415 B1 9/2003 Renken et al.
6,629,420 B2 10/2003 Renders
6,647,735 B2 11/2003 Street et al.
6,658,373 B2 12/2003 Rossi et al.
6,672,846 B2 1/2004 Rajendran et al.

(56) References Cited

U.S. PATENT DOCUMENTS

| | | | | |
|---|---|---|---|---|
| 6,675,591 | B2 | 1/2004 | Singh et al. | |
| 6,679,072 | B2 | 1/2004 | Pham et al. | |
| 6,685,438 | B2 | 2/2004 | Yoo et al. | |
| 6,709,244 | B2 | 3/2004 | Pham | |
| 6,711,911 | B1 | 3/2004 | Grabon et al. | |
| 6,758,050 | B2 * | 7/2004 | Jayanth et al. | 62/126 |
| 6,758,051 | B2 | 7/2004 | Jayanth et al. | |
| 6,760,207 | B2 | 7/2004 | Wyatt et al. | |
| 6,799,951 | B2 | 10/2004 | Lifson et al. | |
| 6,811,380 | B2 | 11/2004 | Kim | |
| 6,823,680 | B2 | 11/2004 | Jayanth | |
| 6,829,542 | B1 | 12/2004 | Reynolds et al. | |
| 6,832,120 | B1 | 12/2004 | Frank et al. | |
| 6,832,898 | B2 | 12/2004 | Yoshida et al. | |
| 6,869,272 | B2 | 3/2005 | Odachi et al. | |
| 6,934,862 | B2 | 8/2005 | Sharood et al. | |
| 6,964,558 | B2 | 11/2005 | Hahn et al. | |
| 6,966,759 | B2 | 11/2005 | Hahn et al. | |
| 6,973,794 | B2 | 12/2005 | Street et al. | |
| 6,981,384 | B2 | 1/2006 | Dobmeier et al. | |
| 6,986,469 | B2 | 1/2006 | Gauthier et al. | |
| 6,999,996 | B2 | 2/2006 | Sunderland | |
| 7,000,422 | B2 | 2/2006 | Street et al. | |
| 7,047,753 | B2 | 5/2006 | Street et al. | |
| 7,079,967 | B2 | 7/2006 | Rossi et al. | |
| 7,113,376 | B2 | 9/2006 | Nomura et al. | |
| 7,123,458 | B2 | 10/2006 | Mohr et al. | |
| 7,130,170 | B2 | 10/2006 | Wakefield et al. | |
| 7,134,295 | B2 | 11/2006 | Maekawa | |
| 7,174,728 | B2 | 2/2007 | Jayanth | |
| 7,228,691 | B2 | 6/2007 | Street et al. | |
| 7,270,278 | B2 | 9/2007 | Street et al. | |
| 7,412,842 | B2 | 8/2008 | Pham | |
| 7,421,850 | B2 | 9/2008 | Street et al. | |
| 7,447,603 | B2 | 11/2008 | Bruno | |
| 7,458,223 | B2 | 12/2008 | Pham | |
| 7,484,376 | B2 | 2/2009 | Pham | |
| 7,491,034 | B2 | 2/2009 | Jayanth | |
| 2001/0005320 | A1 | 6/2001 | Ueda et al. | |
| 2001/0025349 | A1 | 9/2001 | Sharood et al. | |
| 2001/0054293 | A1 | 12/2001 | Gustafson et al. | |
| 2001/0054294 | A1 | 12/2001 | Tsuboi | |
| 2002/0018724 | A1 | 2/2002 | Millet et al. | |
| 2002/0020175 | A1 | 2/2002 | Street et al. | |
| 2002/0040280 | A1 | 4/2002 | Morgan | |
| 2002/0064463 | A1 | 5/2002 | Park et al. | |
| 2002/0067999 | A1 | 6/2002 | Suitou et al. | |
| 2002/0093259 | A1 | 7/2002 | Sunaga et al. | |
| 2002/0127120 | A1 | 9/2002 | Hahn et al. | |
| 2002/0139128 | A1 | 10/2002 | Suzuki et al. | |
| 2002/0159890 | A1 | 10/2002 | Kajiwara et al. | |
| 2002/0170299 | A1 | 11/2002 | Jayanth et al. | |
| 2003/0019221 | A1 * | 1/2003 | Rossi et al. | 62/127 |
| 2003/0037555 | A1 | 2/2003 | Street et al. | |
| 2003/0078742 | A1 | 4/2003 | VanderZee et al. | |
| 2003/0094004 | A1 | 5/2003 | Pham et al. | |
| 2003/0108430 | A1 | 6/2003 | Yoshida et al. | |
| 2003/0115890 | A1 | 6/2003 | Jayanth et al. | |
| 2004/0016241 | A1 | 1/2004 | Street et al. | |
| 2004/0016244 | A1 | 1/2004 | Street et al. | |
| 2004/0016251 | A1 | 1/2004 | Street et al. | |
| 2004/0016253 | A1 | 1/2004 | Street et al. | |
| 2004/0024495 | A1 | 2/2004 | Sunderland | |
| 2004/0037706 | A1 | 2/2004 | Hahn et al. | |
| 2004/0042904 | A1 | 3/2004 | Kim | |
| 2004/0093879 | A1 | 5/2004 | Street et al. | |
| 2004/0133367 | A1 | 7/2004 | Hart | |
| 2004/0144106 | A1 * | 7/2004 | Douglas et al. | 62/127 |
| 2004/0184627 | A1 | 9/2004 | Kost et al. | |
| 2004/0184928 | A1 | 9/2004 | Millet et al. | |
| 2004/0184929 | A1 | 9/2004 | Millet et al. | |
| 2004/0184930 | A1 | 9/2004 | Millet et al. | |
| 2004/0184931 | A1 | 9/2004 | Millet et al. | |
| 2004/0187502 | A1 | 9/2004 | Jayanth et al. | |
| 2004/0191073 | A1 | 9/2004 | Iimura et al. | |
| 2004/0258542 | A1 | 12/2004 | Wiertz et al. | |
| 2004/0261431 | A1 | 12/2004 | Singh et al. | |
| 2005/0040249 | A1 | 2/2005 | Wacker et al. | |
| 2005/0053471 | A1 | 3/2005 | Hong et al. | |
| 2005/0100449 | A1 | 5/2005 | Hahn et al. | |
| 2005/0103036 | A1 | 5/2005 | Maekawa | |
| 2005/0166610 | A1 | 8/2005 | Jayanth | |
| 2005/0172647 | A1 * | 8/2005 | Thybo et al. | 62/129 |
| 2005/0214148 | A1 | 9/2005 | Ogawa et al. | |
| 2005/0232781 | A1 | 10/2005 | Herbert et al. | |
| 2005/0235660 | A1 | 10/2005 | Pham | |
| 2005/0235661 | A1 | 10/2005 | Pham | |
| 2005/0235662 | A1 | 10/2005 | Pham | |
| 2005/0235663 | A1 | 10/2005 | Pham | |
| 2005/0252220 | A1 | 11/2005 | Street et al. | |
| 2005/0262856 | A1 | 12/2005 | Street et al. | |
| 2006/0117773 | A1 | 6/2006 | Street et al. | |
| 2006/0129339 | A1 | 6/2006 | Bruno | |
| 2006/0151037 | A1 | 7/2006 | Lepola et al. | |
| 2006/0185373 | A1 | 8/2006 | Butler et al. | |
| 2006/0256488 | A1 | 11/2006 | Benzing et al. | |
| 2006/0280627 | A1 | 12/2006 | Jayanth | |
| 2007/0002505 | A1 | 1/2007 | Watanabe et al. | |
| 2008/0209925 | A1 | 9/2008 | Pham | |
| 2008/0216494 | A1 * | 9/2008 | Pham et al. | 62/127 |
| 2009/0071175 | A1 * | 3/2009 | Pham | 62/129 |
| 2010/0089076 | A1 | 4/2010 | Schuster et al. | |

FOREIGN PATENT DOCUMENTS

| | | | |
|---|---|---|---|
| DE | 1403467 | | 10/1969 |
| DE | 3118638 | | 7/1995 |
| DE | 297 23 145 | U1 | 4/1998 |
| EP | 0060172 | A1 | 9/1982 |
| EP | 0085246 | | 8/1983 |
| EP | 0 355 255 | | 2/1990 |
| EP | 0361394 | A2 | 4/1990 |
| EP | 0398436 | A1 | 11/1990 |
| EP | 0453302 | | 10/1991 |
| EP | 0351272 | | 5/1994 |
| EP | 0877462 | | 11/1998 |
| EP | 1 087 184 | A2 | 9/2000 |
| EP | 1245912 | | 10/2002 |
| FR | 2 472 862 | | 3/1981 |
| GB | 2062919 | | 5/1981 |
| JP | 63061783 | | 3/1988 |
| JP | 02110242 | | 4/1990 |
| JP | 02 294580 | A | 5/1990 |
| JP | 06 058273 | A | 1/1994 |
| JP | 08021675 | A | 1/1996 |
| JP | 2002-155868 | | 5/2002 |
| JP | 2003-176788 | | 6/2003 |
| JP | 2004-316504 | | 11/2004 |
| JP | 2005188790 | A | 7/2005 |
| JP | 2006-046219 | | 2/2006 |
| KR | 10-2000-0025265 | | 5/2000 |
| KR | 10-2002-0041977 | | 6/2002 |
| KR | 10-2004-0021281 | | 3/2004 |
| KR | 10-2006-0020353 | | 3/2006 |
| WO | WO 88/06703 | | 9/1988 |
| WO | WO 97 18636 | | 5/1997 |
| WO | WO 99 17066 | | 8/1999 |
| WO | 9961847 | A1 | 12/1999 |
| WO | 9965681 | A1 | 12/1999 |
| WO | 0051223 | A1 | 8/2000 |
| WO | WO 01/69147 | A1 | 9/2001 |
| WO | WO 02/075227 | | 9/2002 |
| WO | WO 2005/108882 | | 11/2005 |
| WO | WO 2006/025880 | | 3/2006 |
| WO | 2009/058356 | | 5/2009 |

OTHER PUBLICATIONS

Written Opinion of the International Searching Authority regarding International Application No. PCT/US2007/019563, Jan. 15, 2008.

Einstein RX-300 Refrigeration Controller Installation and Operation Manual, Computer Process Controls, Apr. 1, 1998.

Translation of Claims and Abstract of KR Patent Laying-Open No. 2000-0000261; 4 pages, Jan. 15, 2000.

(56) References Cited

OTHER PUBLICATIONS

International Search Report for International Application No. PCT/US2008/012362, dated Feb. 12, 2009.
International Search Report for International Application No. PCT/US2008/012364 dated Mar. 13, 2009.
Written Opinion of the International Searching Authority for International Application No. PCT/US2008/012364 dated Mar. 13, 2009.
International Preliminary Report on Patentability regarding International Application No. PCT/US2007/019563 dated Mar. 10, 2009.
International Search Report for International Application No. PCT/US2005/11154, dated Oct. 19, 2005.
First Office Action issued by the Chinese Patent Office on May 30, 2008 regarding Application No. 200580013451.8.
Second Office Action issued by the Chinese Patent Office on Mar. 6, 2009 regarding Application No. 200580013451.8.
Third Office Action issued by the Chinese Patent Office on Jun. 19, 2009 regarding Application No. 200580013451.8, translated by CCPIT Patent and Trademark Law Office.
First Office Action from the Patent Office of the People's Republic of China regarding Application No. 200510005907.8, dated Jun. 29, 2007.
Second Office action issued by the Chinese Patent Office dated Jun. 19, 2009 regarding Application No. 200510005907.8, translation provided by CCPIT Patent and Trademark Law Office.
"A Practical Example of a Building's Automatic Control," cited in First Office Action from the Patent Office of the People's Republic of China dated Jun. 29, 2007, regarding Application No. 200510005907.8, including translation by CCPIT Patent and Trademark Law Office.
"Product Performance Introduction of York Company," cited in First Office Action from the Patent Office of the People's Republic of China dated Jun. 29, 2007 regarding Application No. 200510005907.8, including translation by CCPIT Patent and Trademark Law Office.
Ultrasite 32 User's Guide, Computer Process Controls, Sep. 28, 1999.
Ultrasite User's Guide BEC Supplement, Computer Process Controls, Oct. 6, 1997.
Ultrasite User's Guide BCU Supplement, Computer Process Controls, Sep. 4, 1997.
Ultrasite User's Guide RMCC Supplement, Computer Process Controls, Jun. 9, 1997.
Refrigeration Monitor and Case Control Installation and Operation Manual, Computer Process Controls, Aug. 12, 1999.
Building Environmental Control (BEC) Installation and Operation Manual, Computer Process Controls, Jan. 5, 1998.
Building Control Unit (BCU) Installation and Operation Manual, Computer Process Controls, Jan. 28, 1998.
International Preliminary Report on Patentability for International Application No. PCT/US2008/012362, dated May 4, 2010.
International Preliminary Report on Patentability for International Application No. PCT/US2008/012364, dated May 4, 2010.
First Office Action issued by the Chinese Patent Office regarding Application No. 200780030810.X dated Dec. 25, 2009.
"Small-type Freezing and Air Conditioning Operation," Chinese State Economy and Trading Committee, China Meteorological Press, Mar. 2003.
"Manual for Freezing and Air Conditioning Technology," Fan Jili, Liaoning Science and Technology Press, Sep. 1995.
International Search Report for International Application No. PCT/US2007/016135 dated Oct. 22, 2007.
Office Action regarding U.S. Appl. No. 11/850,846, dated Aug. 13, 2010.
Second Office Action regarding Chinese Patent Appplication No. 200780030810X, dated Aug. 4, 2010. English translation provided by Unitalen Attorneys at Law.
Final Office Action for U.S. Appl. No. 12/054,011, dated Jun. 30, 2011.
First Office Action regarding Chinese Application No. 200880106319.5, dated May 25, 2011. English translation provided by Unitalen Attorneys at Law.
Non-Final Office Action for U.S. Appl. No. 12/054,011, dated Oct. 20, 2011.
Non-Final Office Action regarding U.S. Appl. No. 12/261,643, dated Jan. 27, 2011.
Official Action regarding Australian Patent Application No. 2008325240, dated Jan. 19, 2011.
Second Office Action regarding Chinese Patent Application No. 200890100287.3, dated Jan. 27, 2011. English translation provided by Unitalen Attorneys at Law.
First Office Action regarding Chinese Patent Application No. 200780032977.X, dated Sep. 27, 2010. English translation provided by Unitalen Attorneys at Law.
First Office Action regarding Chinese Patent Application No. 201010117657.8, dated Dec. 29, 2010. English translation provided by Unitalen Attorneys at Law.
International Search Report for International Application No. PCT/US2008/009618, dated Dec. 8, 2008.
Written Opinion of International Searching Authority for International Application No. PCT/US2008/009618, dated Dec. 8, 2008.
International Preliminary Report on Patentability for International Application No. PCT/US2008/009618, dated Apr. 1, 2010.
First Office Action issued by the Chinese Patent Office for Application No. 200480015875.3, dated Sep. 5, 2008.
Second Office Action issued by the Chinese Patent Office for Application No. 200480015875.3, dated Feb. 27, 2009.
BChydro, "Power Factor" Guides to Energy Management: The GEM Series, Dec. 2000.
European Search Report for Application No. EP 06 02 6263, dated Jul. 17, 2007.
European Search Report for Application No. EP 04 81 5853, dated Jul. 17, 2007.
European Search Report for Application No. EP 02 25 1531, dated Sep. 30, 2002.
International Search Report for International Application No. PCT/US04/43859, dated Mar. 2, 2006.
European Search Report for Application No. EP 01 30 1752, dated Mar. 26, 2002.
Final Office Action mailed Dec. 7, 2010 for U.S. Appl. No. 12/054,011.
Non-Final Office Action mailed Mar. 3, 2011 for U.S. Appl. No. 12/054,011.
Non-Final Office Action mailed Aug. 13, 2010 for U.S. Appl. No. 12/054,011.
Final Office Action regarding U.S. Appl. No. 12/261,643, dated Jul. 7, 2011.
Office Action regarding U.S. Appl. No. 12/261,643, dated Nov. 2, 2011.
Office Action regarding U.S. Appl. No. 12/261,677, dated Aug. 4, 2011.
Notice of Allowance regarding U.S. Appl. No. 12/261,677, dated Dec. 15, 2011.
Office Action regarding U.S. Appl. No. 12/261,643, dated Feb. 15, 2012.
Examiner's Report No. 2 regarding Australian Patent Application No. 2008325240, dated Mar. 5, 2012.
Non-Final Office Action regarding U.S. Appl. No. 13/176,021, dated May 8, 2012.
Final Office Action regarding U.S. Appl. No. 12/261,643, dated Jun. 27, 2012.
Non-Final office Action regarding U.S. Appl. No. 11/850,846, dated Apr. 24, 2012.
Non-Final Office Action for U.S. Appl. No. 12/054,011, dated Apr. 10, 2012.
European Search Report regarding Application No. 04022784.5-2315/1500821, dated Aug. 14, 2012.
Patent Examination Report No. 3 regarding Australian Patent Application No. 2008325240, dated Jul. 19, 2012.
Third Office Action regarding Chinese Application No. 2005100059078 from the State Intellectual Property Office of People's Republic of China, dated Aug. 24, 2011. Translation provided by Unitalen Attorneys at Law.

(56) References Cited

OTHER PUBLICATIONS

Fourth Office Action from the State Intellectual Property Office of People's Republic of China regarding Chinese Patent Applicaiton No. 200510005907.8, dated Dec. 8, 2011. Translation provided by Unitalen Attorneys at Law.

Final Office Action for U.S. Appl. No. 11/850,846, mailed Aug. 13, 2012.

Examiner's First Report on Australian Patent Application No. 2007292917 dated Jan. 10, 2012.

Examiner's First Report on Australian Patent Application No. 2008319275, dated Jan. 31, 2011.

* cited by examiner

| | | Sensors | | | |
|---|---|---|---|---|---|
| Fault Area | Diagnostics | Current and Voltage | Discharge-Line Temperature | Outdoor Temperature | Liquid-Line Temperature |
| Compressor | Locking Rotor | X | | | |
| | Motor Failure | X | | | |
| | Insufficient Pumping | | X | | |
| System- High Side | Cycling on Protection | | | | |
| | Cond Low Air/ Dirty Coil | X | | X | X |
| | Overcharge/ Non- Cond. | X | | X | X |
| System- Low Side | Excessive Run Time | | | | |
| | Loss of Charge | X | X | | X |
| | Evap Low Air/ Stuck Orifice | X | X | | |
| System- Electrical | Open Run Circuit | X | | | |
| | Open Start Circuit | X | | | |
| | Open Circuit | X | | | |
| | Welded Contractor | X | | | |
| | Low Voltage | X | | | |
| | Short Cycling | X | | | |
| System Performance | Monitor Efficiency | X | X | X | X |
| | Installation Check | X | X | X | X |

Fig-11

PROTECTION AND DIAGNOSTIC MODULE FOR A REFRIGERATION SYSTEM

CROSS-REFERENCE TO RELATED APPLICATIONS

This application claims the benefit of U.S. Provisional Application No. 60/831,755, filed on Jul. 19, 2006. The disclosure of the above application is incorporated herein by reference.

FIELD

The present disclosure relates to compressors, and more particularly, to a diagnostic system for use with a compressor.

BACKGROUND

The statements in this section merely provide background information related to the present disclosure and may not constitute prior art.

Compressors are used in a wide variety of industrial and residential applications to circulate refrigerant within a refrigeration, heat pump, HVAC, or chiller system (generically referred to as "refrigeration systems") to provide a desired heating and/or cooling effect. In any of the foregoing applications, the compressor should provide consistent and efficient operation to ensure that the particular refrigeration system functions properly.

Refrigeration systems and associated compressors may include a protection system that intermittently restricts power to the compressor to prevent operation of the compressor and associated components of the refrigeration system (i.e., evaporator, condenser, etc.) when conditions are unfavorable. The types of faults that may cause protection concerns include electrical, mechanical, and system faults. Electrical faults typically have a direct effect on an electrical motor associated with the compressor, while mechanical faults generally include faulty bearings or broken parts. Mechanical faults often raise a temperature of working components within the compressor, and thus, may cause malfunction of, and possible damage to, the compressor.

In addition to electrical faults and mechanical faults associated with the compressor, the compressor and refrigeration system components may also be affected by system faults attributed to system conditions such as an adverse level of fluid disposed within the system or to a blocked-flow condition external to the compressor. Such system conditions may raise an internal compressor temperature or pressure to high levels, thereby damaging the compressor and causing system inefficiencies and/or failures. To prevent system and compressor damage or failure, the compressor may be shut down by the protection system when any of the aforementioned conditions are present.

Conventional protection systems typically sense temperature and/or pressure parameters as discrete switches and interrupt power supplied to the electrical motor of the compressor should a predetermined temperature or pressure threshold be exceeded. Typically, a plurality of sensors are required to measure and monitor the various system and compressor operating parameters. With each parameter measured, at least one sensor is typically required, and therefore results in a complex protection system in which many sensors are employed.

Sensors associated with conventional protection systems are required to quickly and accurately detect particular faults experienced by the compressor and/or system. Without such plurality of sensors, conventional systems would merely shut down the compressor when a predetermined threshold mode and/or current is experienced. Repeatedly shutting down the compressor whenever a fault condition is experienced results in frequent service calls and repairs to the compressor to properly diagnose and remedy the fault. In this manner, while conventional protection devices adequately protect a compressor and system to which the compressor may be tied, conventional protection systems fail to precisely indicate a particular fault and often require a plurality of sensors to diagnose the compressor and/or system.

SUMMARY

A system includes a compressor and a compressor motor functioning in a refrigeration circuit. A sensor produces a signal indicative of one of current and power drawn by the motor and a liquid-line temperature sensor provides a signal indicative of a temperature of liquid circulating within the refrigeration circuit. Processing circuitry processes the current or power signal to determine a condenser temperature of the refrigeration circuit and a subcooling value of the refrigeration circuit from the condenser temperature and the liquid-line temperature signal.

In another configuration, a system includes a compressor and a compressor motor functioning in a refrigeration circuit. A liquid-line temperature sensor provides a signal indicative of a temperature of subcooled liquid circulating within the refrigeration circuit and processing circuitry determines a condenser temperature using a compressor map. The processing circuitry also determines a subcooling value of the refrigeration circuit from the condenser temperature and the liquid-line temperature signal.

In another configuration, a system includes a compressor and a compressor motor functioning in a refrigeration circuit. An ambient temperature sensor provides a signal indicative of ambient temperature and a discharge-line temperature sensor provides a signal indicative of a discharge-line temperature of the compressor. Processing circuitry determines a condenser temperature using a compressor map and determines a discharge superheat value of the refrigeration circuit from the ambient temperature signal, the discharge-line temperature signal, and the condenser temperature.

In yet another configuration, a system includes a compressor and a compressor motor functioning in a refrigeration circuit. One of a current sensor and a power sensor produces a signal indicative of a current drawn by the motor or a power drawn by the motor and a discharge-line temperature sensor produces a signal indicative of a discharge-line temperature of the compressor. An ambient temperature sensor produces a signal indicative of an ambient temperature and a liquid-line temperature sensor provides a signal indicative of a liquid circulating within the refrigeration circuit. Processing circuitry processes the current signal or the power signal to determine a condenser temperature of the refrigeration circuit and processes at least two of the condenser temperature, the current or power signal, the discharge-line temperature signal, the ambient temperature signal, and the liquid-line temperature signal to determine at least one of a subcooling value of the refrigeration circuit, a condenser temperature difference, and a discharge superheat of the refrigeration circuit.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 11 is a table illustrating various sensor combinations used to detect specific fault conditions;

DETAILED DESCRIPTION

Figure 1:
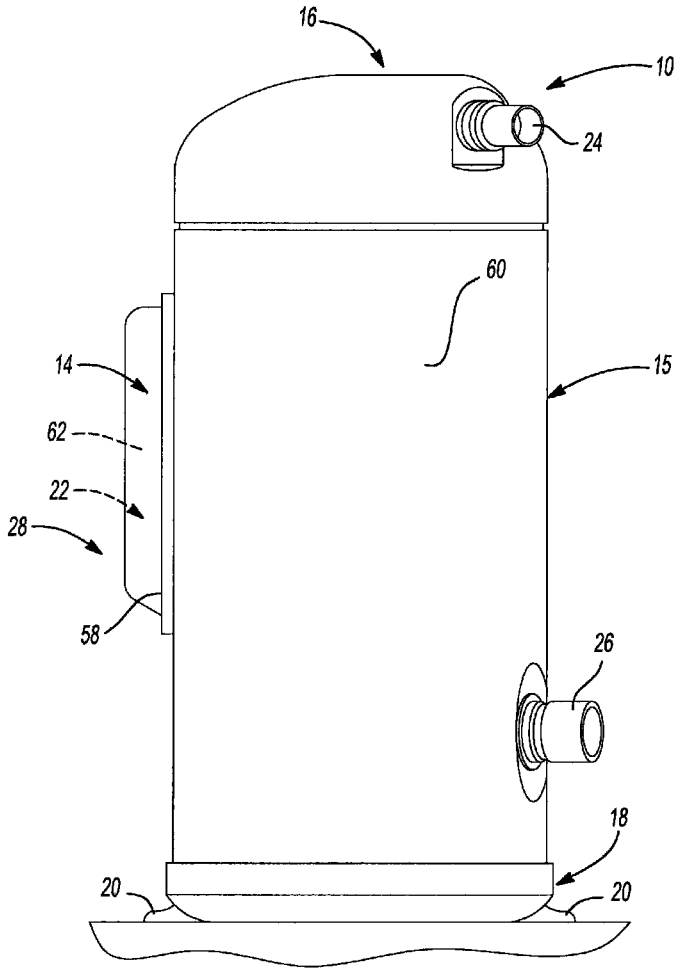
FIG. 1 is a perspective view of a compressor incorporating a protection system in accordance with the principles of the present teachings.

The following description is merely exemplary in nature and is not intended to limit the present disclosure, application, or uses. It should be understood that throughout the drawings, corresponding reference numerals indicate like or corresponding parts and features.

With reference to the drawings, a compressor 10 is shown incorporated into a refrigeration system 12. A protection and control system 14 is associated with the compressor 10 and the refrigeration system 12 to monitor and diagnose both the compressor 10 and the refrigeration system 12. The protection and control system 14 utilizes a series of sensors to determine non-measured operating parameters of the compressor 10 and/or refrigeration system 12. The protection and control system 14 uses the non-measured operating parameters in conjunction with measured operating parameters from the sensors to diagnose and protect the compressor 10 and/or refrigeration system 12.

Figure 2:
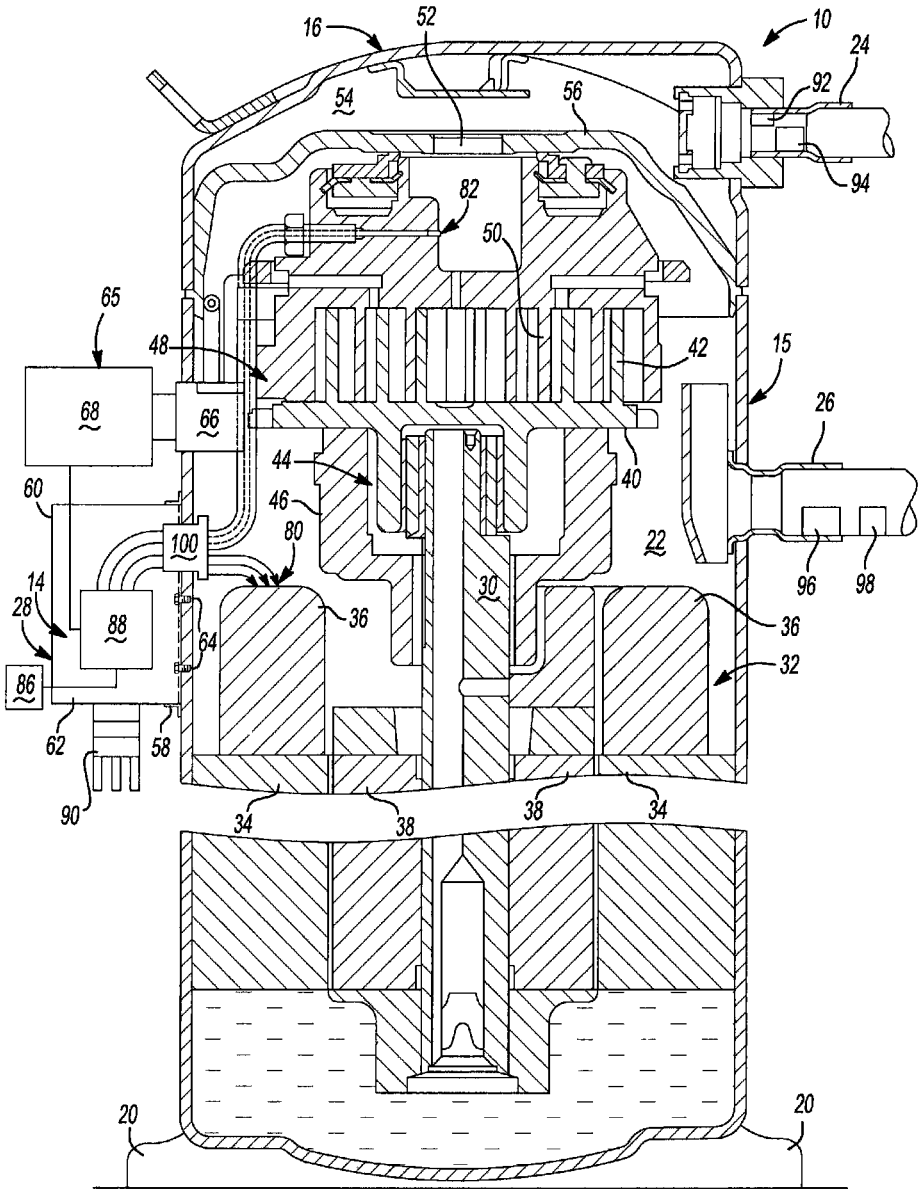
FIG. 2 is a cross-sectional view of the compressor of FIG. 1.

With particular reference to FIGS. 1 and 2, the compressor 10 is shown to include a generally cylindrical hermetic shell 15 having a welded cap 16 at a top portion and a base 18 having a plurality of feet 20 welded at a bottom portion. The cap 16 and the base 18 are fitted to the shell 15 such that an interior volume 22 of the compressor 10 is defined. The cap 16 is provided with a discharge fitting 24, while the shell 15 is similarly provided with an inlet fitting 26, disposed generally between the cap 16 and base 18, as best shown in FIG. 2. In addition, an electrical enclosure 28 is fixedly attached to the shell 15 generally between the cap 16 and the base 18 and operably supports a portion of the protection and control system 14 therein.

A crankshaft 30 is rotatably driven by an electric motor 32 relative to the shell 15. The motor 32 includes a stator 34 fixedly supported by the hermetic shell 15, windings 36 passing therethrough, and a rotor 38 press-fit on the crankshaft 30. The motor 32 and associated stator 34, windings 36, and rotor 38 cooperate to drive the crankshaft 30 relative to the shell 15 to compress a fluid.

The compressor 10 further includes an orbiting scroll member 40 having a spiral vein or wrap 42 on an upper surface thereof for use in receiving and compressing a fluid. An Oldham coupling 44 is disposed generally between the orbiting scroll member 40 and bearing housing 46 and is keyed to the orbiting scroll member 40 and a non-orbiting scroll member 48. The Oldham coupling 44 transmits rotational forces from the crankshaft 30 to the orbiting scroll member 40 to compress a fluid disposed generally between the orbiting scroll member 40 and the non-orbiting scroll member 48. Oldham coupling 44, and its interaction with orbiting scroll member 40 and non-orbiting scroll member 48, is preferably of the type disclosed in assignee's commonly owned U.S. Pat. No. 5,320,506, the disclosure of which is incorporated herein by reference.

Non-orbiting scroll member 48 also includes a wrap 50 positioned in meshing engagement with the wrap 42 of the orbiting scroll member 40. Non-orbiting scroll member 48 has a centrally disposed discharge passage 52, which communicates with an upwardly open recess 54. Recess 54 is in fluid communication with the discharge fitting 24 defined by the cap 16 and a partition 56, such that compressed fluid exits the shell 15 via discharge passage 52, recess 54, and fitting 24. Non-orbiting scroll member 48 is designed to be mounted to bearing housing 46 in a suitable manner such as disclosed in assignee's commonly owned U.S. Pat. Nos. 4,877,382 and 5,102,316, the disclosures of which are incorporated herein by reference.

The electrical enclosure 28 includes a lower housing 58, an upper housing 60, and a cavity 62. The lower housing 58 is mounted to the shell 15 using a plurality of studs 64, which are welded or otherwise fixedly attached to the shell 15. The upper housing 60 is matingly received by the lower housing 58 and defines the cavity 62 therebetween. The cavity 62 is positioned on the shell 15 of the compressor 10 and may be used to house respective components of the protection and control system 14 and/or other hardware used to control operation of the compressor 10 and/or refrigeration system 12.

With particular reference to FIG. 2, the compressor 10 includes an actuation assembly 65 that selectively separates the orbiting scroll member 40 from the non-orbiting scroll member 48 to modulate a capacity of the compressor 10 between a reduced-capacity mode and a full-capacity mode. The actuation assembly 65 may include a solenoid 66 connected to the orbiting scroll member 40 and a controller 68 coupled to the solenoid 66 for controlling movement of the solenoid 66 between an extended position and a retracted position.

Movement of the solenoid 66 into the extended position separates the wraps 42 of the orbiting scroll member 40 from the wraps 50 of the non-orbiting scroll member 48 to reduce an output of the compressor 10. Conversely, movement of the solenoid 66 into the retracted position moves the wraps 42 of the orbiting scroll member 40 closer to the wraps 50 of the non-orbiting scroll member 48 to increase an output of the compressor. In this manner, the capacity of the compressor 10 may be modulated in accordance with demand or in response to a fault condition. While movement of the solenoid 66 into the extended position is described as separating the wraps 42 of the orbiting scroll member 40 from the wraps 50 of the non-orbiting scroll member 48, movement of the solenoid 66 into the extended position could alternately move the wraps 42 of the orbiting scroll member 40 into engagement with the wraps 50 of the non-orbiting scroll member 48. Similarly, while movement of the solenoid 66 into the retracted position is described as moving the wraps 42 of the orbiting scroll member 40 closer to the wraps 50 of the non-orbiting scroll member 48, movement of the solenoid 66 into the retracted position could alternately move the wraps 42 of the orbiting scroll member 40 away from the wraps 50 of the non-orbiting scroll member 48. The actuation assembly 65 may be of the type disclosed in assignee's commonly owned U.S. Pat. No. 6,412,293, the disclosure of which is incorporated herein by reference.

Figure 3:
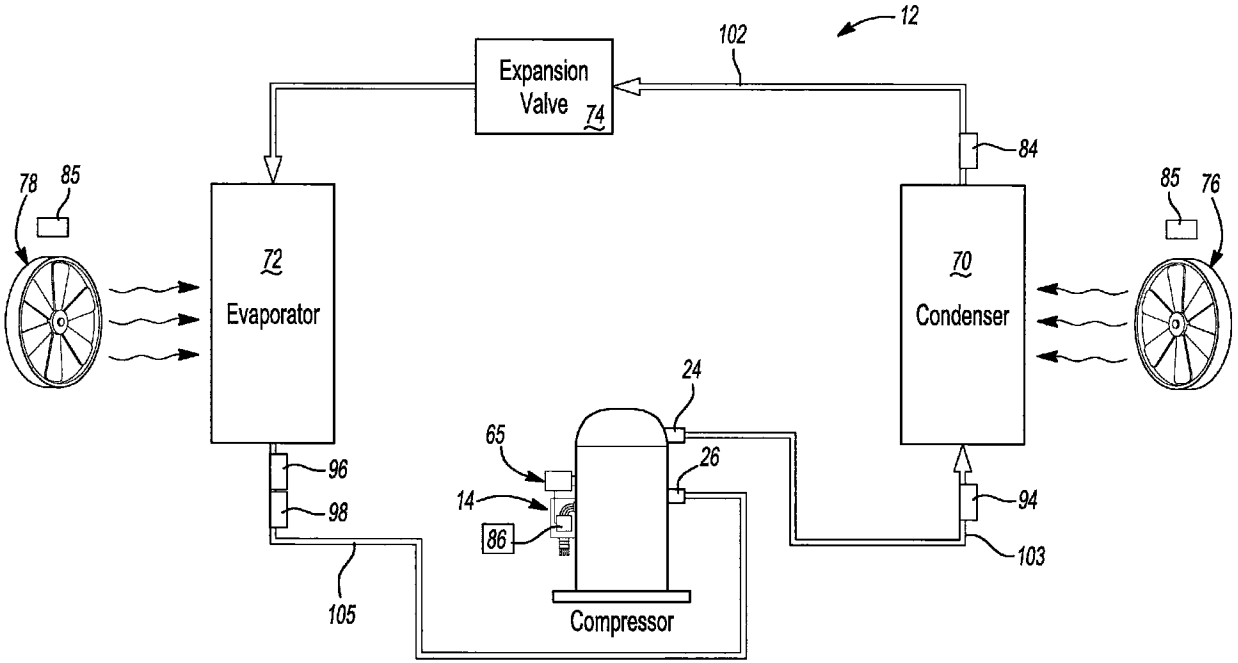
FIG. 3 is a schematic representation of a refrigeration system incorporating the compressor of FIG. 1.

With particular reference to FIG. 3, the refrigeration system 12 is shown to include a condenser 70, an evaporator 72, and an expansion device 74 disposed generally between the condenser 70 and the evaporator 72. The refrigeration system 12 also includes a condenser fan 76 associated with the condenser 70 and an evaporator fan 78 associated with the evaporator 72. Each of the condenser fan 76 and the evaporator fan 78 may be variable-speed fans that can be controlled based on a cooling and/or heating demand of the refrigeration system 12. Furthermore, each of the condenser fan 76 and evaporator fan 78 may be controlled by the protection and control system 14 such that operation of the condenser fan 76 and evaporator fan 78 may be coordinated with operation of the compressor 10.

In operation, the compressor 10 circulates refrigerant generally between the condenser 70 and evaporator 72 to produce a desired heating and/or cooling effect. The compressor 10 receives vapor refrigerant from the evaporator 72 generally at the inlet fitting 26 and compresses the vapor refrigerant between the orbiting scroll member 40 and the non-orbiting scroll member 48 to deliver vapor refrigerant at discharge pressure at discharge fitting 24.

Once the compressor 10 has sufficiently compressed the vapor refrigerant to discharge pressure, the discharge-pressure refrigerant exits the compressor 10 at the discharge fitting 24 and travels within the refrigeration system 12 to the condenser 70. Once the vapor enters the condenser 70, the refrigerant changes phase from a vapor to a liquid, thereby rejecting heat. The rejected heat is removed from the condenser 70 through circulation of air through the condenser 70 by the condenser fan 76. When the refrigerant has sufficiently changed phase from a vapor to a liquid, the refrigerant exits the condenser 70 and travels within the refrigeration system 12 generally towards the expansion device 74 and evaporator 72.

Upon exiting the condenser 70, the refrigerant first encounters the expansion device 74. Once the expansion device 74 has sufficiently expanded the liquid refrigerant, the liquid refrigerant enters the evaporator 72 to change phase from a liquid to a vapor. Once disposed within the evaporator 72, the liquid refrigerant absorbs heat, thereby changing from a liquid to a vapor and producing a cooling effect. If the evaporator 72 is disposed within an interior of a building, the desired cooling effect is circulated into the building to cool the building by the evaporator fan 78. If the evaporator 72 is associated with a heat-pump refrigeration system, the evaporator 72 may be located remote from the building such that the cooling effect is lost to the atmosphere and the rejected heat experienced by the condenser 70 is directed to the interior of the building to heat the building. In either configuration, once the refrigerant has sufficiently changed phase from a liquid to a vapor, the vaporized refrigerant is received by the inlet fitting 26 of the compressor 10 to begin the cycle anew.

With particular reference to FIGS. 2 and 3, the protection and control system 14 is shown to include a high-side sensor 80, a low-side sensor 82, a liquid-line temperature sensor 84, and an outdoor/ambient temperature sensor 86. The protection and control system 14 also includes processing circuitry 88 and a power-interruption system 90, each of which may be disposed within the electrical enclosure 28 mounted to the shell 15 of the compressor 10. The sensors 80, 82, 84, 86 cooperate to provide the processing circuitry 88 with sensor data for use by the processing circuitry 88 in determining non-measured operating parameters of the compressor 10 and/or refrigeration system 12. The processing circuitry 88 uses the sensor data and the determined non-measured operating parameters to diagnose the compressor 10 and/or refrigeration system 12 and selectively restricts power to the electric motor of the compressor 10 via the power-interruption system 90, depending on the identified fault.

The high-side sensor 80 generally provides diagnostics related to high-side faults such as compressor mechanical failures, motor failures, and electrical component failures such as missing phase, reverse phase, motor winding current imbalance, open circuit, low voltage, locked rotor current, excessive motor winding temperature, welded or open contactors, and short cycling. The high-side sensor 80 may be a current sensor that monitors compressor current and voltage to determine and differentiate between mechanical failures, motor failures, and electrical component failures. The high-side sensor 80 may be mounted within the electrical enclosure 28 or may alternatively be incorporated inside the shell 15 of the compressor 10 (FIG. 2). In either case, the high-side sensor 80 monitors current drawn by the compressor 10 and generates a signal indicative thereof, such as disclosed in assignee's commonly owned U.S. Pat. No. 6,615,594, U.S. patent application Ser. No. 11/027,757 filed on Dec. 30, 2004 and U.S. patent application Ser. No. 11/059,646 filed on Feb. 16, 2005, the disclosures of which are incorporated herein by reference.

While the high-side sensor 80 as described herein may provide compressor current information, the protection and control system 14 may also include a discharge pressure sensor 92 mounted in a discharge pressure zone and/or a temperature sensor 94 mounted within or near the compressor shell 15 such as within the discharge fitting 24 (FIG. 2). The temperature sensor 94 may additionally or alternatively be positioned external of the compressor 10 along a conduit 103 extending generally between the compressor 10 and the condenser 70 (FIG. 3) and may be disposed in close proximity to an inlet of the condenser 70. Any or all of the foregoing sensors may be used in conjunction with the high-side sensor 80 to provide the protection and control system 14 with additional system information.

The low-side sensor 82 generally provides diagnostics related to low-side faults such as a low charge in the refrigerant, a plugged orifice, an evaporator fan failure, or a leak in the compressor 10. The low-side sensor 82 may be disposed proximate to the discharge fitting 24 or the discharge passage 52 of the compressor 10 and monitors a discharge-line temperature of a compressed fluid exiting the compressor 10. In addition to the foregoing, the low-side sensor 82 may be disposed external from the compressor shell 15 and proximate to the discharge fitting 24 such that vapor at discharge pressure encounters the low-side sensor 82. Locating the low-side sensor 82 external of the shell 15 allows flexibility in compressor and system design by providing the low-side sensor 82 with the ability to be readily adapted for use with practically any compressor and any system.

While the low-side sensor 82 may provide discharge-line temperature information, the protection and control system 14 may also include a suction pressure sensor 96 or a low-side temperature sensor 98, which may be mounted proximate to an inlet of the compressor 10 such as the inlet fitting 26 (FIG. 2). The suction pressure sensor 96 and low-side temperature sensor 98 may additionally or alternatively be disposed along a conduit 105 extending generally between the evaporator 72 and the compressor 10 (FIG. 3) and may be disposed in close proximity to an outlet of the evaporator 72. Any or all of the foregoing sensors may be used in conjunction with the low-side sensor 82 to provide the protection and control system 14 with additional system information.

While the low-side sensor 82 may be positioned external to the shell 15 of the compressor 10, the discharge temperature of the compressor 10 can similarly be measured within the shell 15 of the compressor 10. A discharge core temperature, taken generally at the discharge fitting 24, could be used in place of the discharge-line temperature arrangement shown in FIG. 2. A hermetic terminal assembly 100 may be used with such an internal discharge temperature sensor to maintain the sealed nature of the compressor shell 15.

The liquid-line temperature sensor 84 may be positioned either within the condenser 70 or positioned along a conduit 102 extending generally between an outlet of the condenser 70 and the expansion valve 74. In this position, the temperature sensor 84 is located in a position within the refrigeration system 12 that represents a liquid location that is common to both a cooling mode and a heating mode if the refrigeration system 12 is a heat pump.

Because the liquid-line temperature sensor 84 is disposed generally near an outlet of the condenser 70 or along the conduit 102 extending generally between the outlet of the condenser 70 and the expansion valve 74, the liquid-line temperature sensor 84 encounters liquid refrigerant (i.e., after the refrigerant has changed from a vapor to a liquid within the condenser 70) and therefore can provide an indication of a temperature of the liquid refrigerant to the processing circuitry 88. While the liquid-line temperature sensor 84 is described as being near an outlet of the condenser 70 or along a conduit 102 extending between the condenser 70 and the expansion valve 74, the liquid-line temperature sensor 84 may also be placed anywhere within the refrigeration system 12 that would allow the liquid-line temperature sensor 84 to provide an indication of a temperature of liquid refrigerant within the refrigeration system 12 to the processing circuitry 88.

The ambient temperature sensor or outdoor/ambient temperature sensor 86 is located external from the compressor shell 15 and generally provides an indication of the outdoor/ambient temperature surrounding the compressor 10 and/or refrigeration system 12. The outdoor/ambient temperature sensor 86 may be positioned adjacent to the compressor shell 15 such that the outdoor/ambient temperature sensor 86 is in close proximity to the processing circuitry 88 (FIG. 2). Placing the outdoor/ambient temperature sensor 86 in close proximity to the compressor shell 15 provides the processing circuitry 88 with a measure of the temperature generally adjacent to the compressor 10. Locating the outdoor/ambient temperature sensor 86 in close proximity to the compressor shell 15 not only provides the processing circuitry 88 with an accurate measure of the surrounding air around the compressor 10, but also allows the outdoor/ambient temperature sensor 86 to be attached to or within the electrical enclosure 28.

Figure 4:
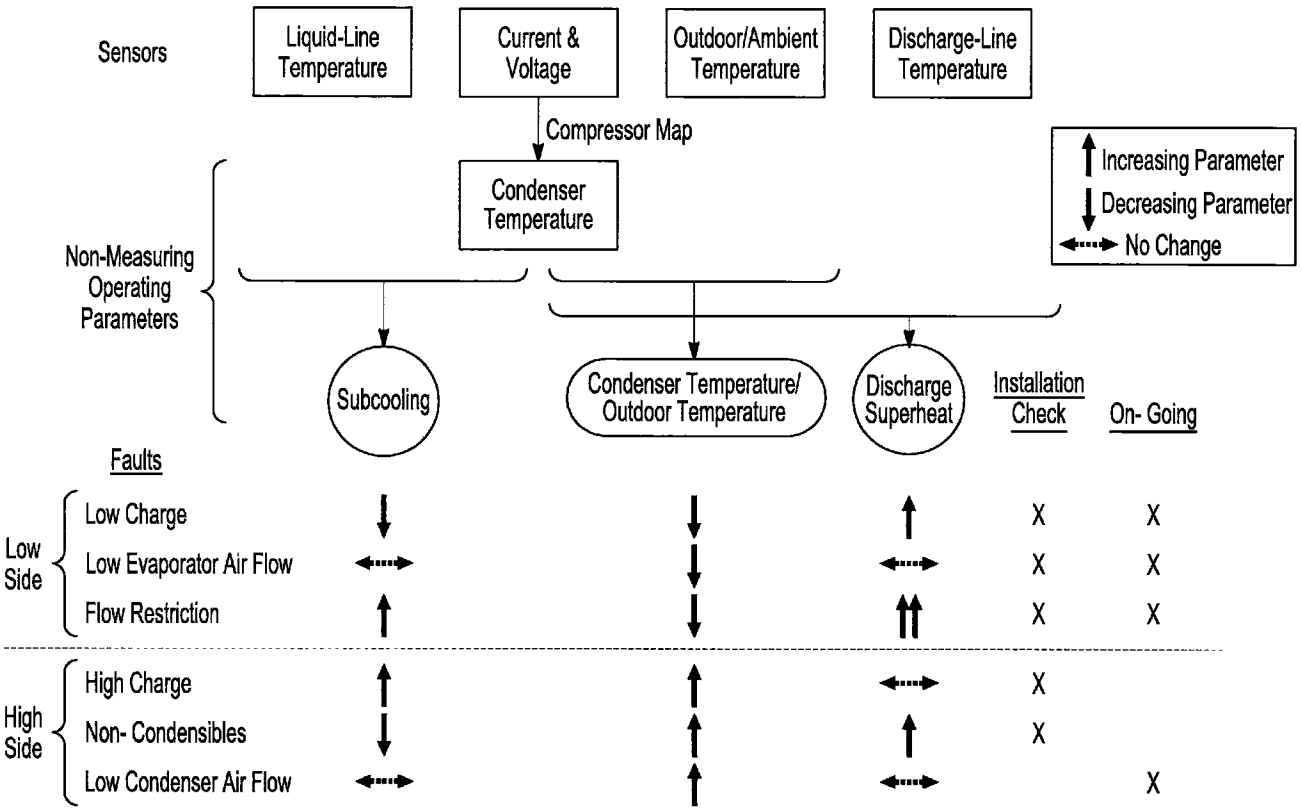
FIG. 4 is a table illustrating various sensor combinations used to detect specific fault conditions.
Figure 5:
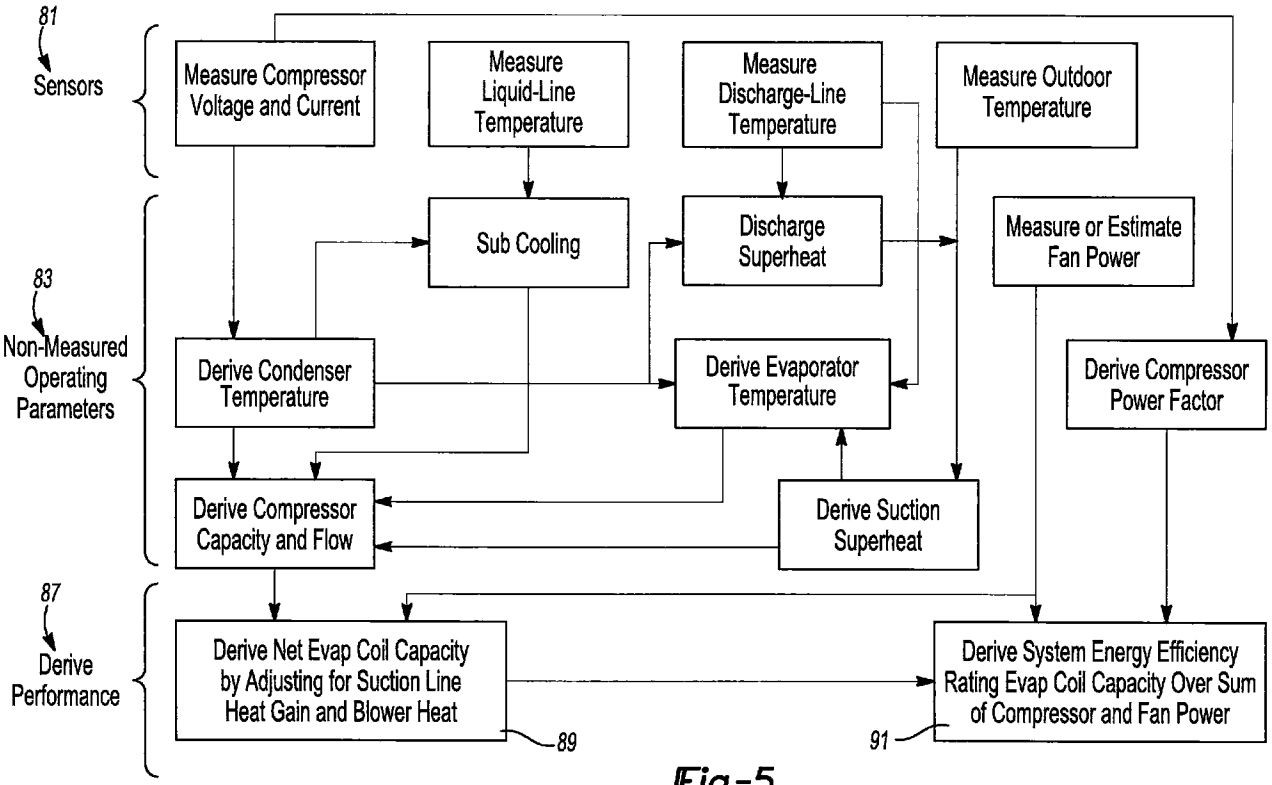
FIG. 5 is a flow chart depicting a process for determining system energy efficiency.

The processing circuitry 88 receives sensor data from the high-side sensor 80, low-side sensor 82, liquid-line temperature sensor 84, and outdoor/ambient temperature sensor 86. As shown in FIGS. 4 and 5, the processing circuitry 88 may use the sensor data from the respective sensors 80, 82, 84, 86 to determine non-measured operating parameters of the compressor 10 and/or refrigeration system 12.

The processing circuitry 88 determines the non-measured operating parameters of the compressor 10 and/or refrigeration system 12 based on the sensor data received from the respective sensors 80, 82, 84, 86 without requiring individual sensors for each of the non-measured operating parameters. The processing circuitry 88 is able to determine a condenser temperature ($T_{cond}$), subcooling of the refrigeration system 12, a temperature difference between the condenser temperature and outdoor/ambient temperature (TD), and a discharge superheat of the refrigeration system 12.

The processing circuitry 88 may determine the condenser temperature by referencing compressor power on a compressor map. The derived condenser temperature is generally the saturated condenser temperature equivalent to the discharge pressure for a particular refrigerant. The condenser temperature should be close to a temperature at a mid-point of the condenser 70. Using a compressor map to determine the condenser temperature provides a more accurate representation of the overall temperature of the condenser 70 when compared to a condenser temperature value provided by a temperature sensor mounted on a coil of the condenser 70 as the condenser coil likely includes many parallel circuits having different temperatures.

Figure 6:
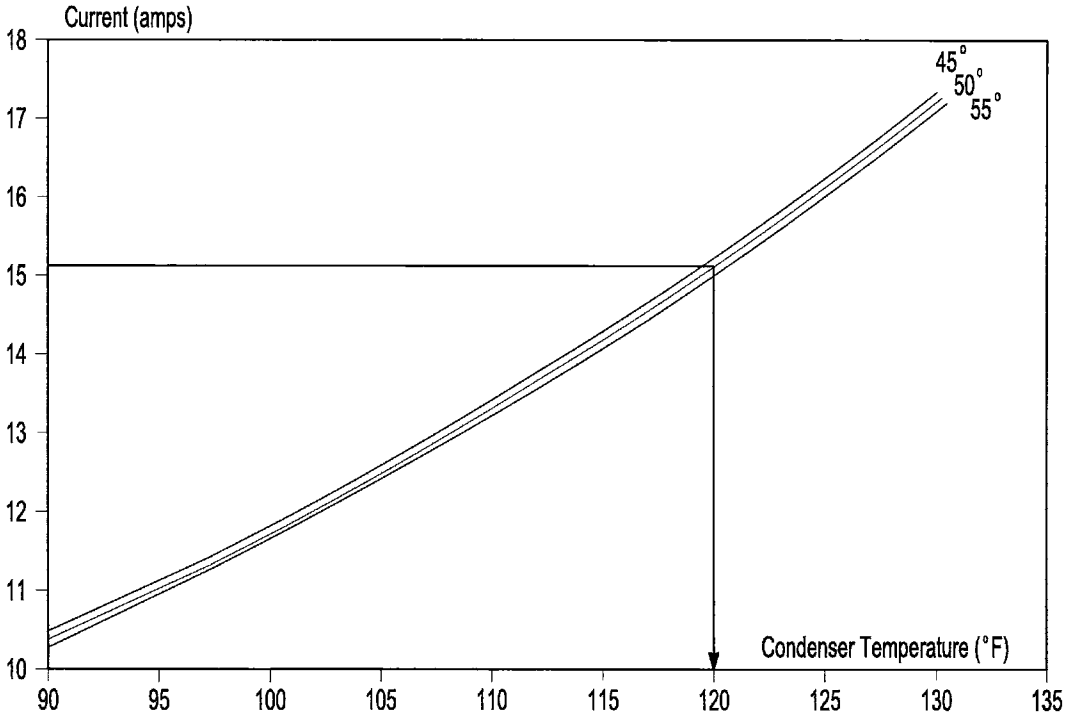
FIG. 6 is a graph of current drawn by a compressor versus condenser temperature for use in determining condenser temperature at a given evaporator temperature.

FIG. 6 is an example of a compressor map showing compressor current versus condenser temperature at various evaporator temperatures ($T_{evap}$). As shown, current remains fairly constant irrespective of evaporator temperature. Therefore, while an exact evaporator temperature can be determined by a second degree polynomial (i.e., a quadratic function), for purposes of control, the evaporator temperature can be determined by a first degree polynomial (i.e., a linear function) and can be approximated as roughly 45, 50, or 55 degrees Fahrenheit. The error associated with choosing an incorrect evaporator temperature is minimal when determining the condenser temperature. While compressor current is shown, compressor power and/or voltage may be used in place of current for use in determining condenser temperature. Compressor power may determined based on the current drawn by motor 32, as indicated by the high-side sensor 80.

Once the compressor current is known and is adjusted for voltage based on a baseline voltage contained in a compressor map (FIG. 6), the condenser temperature may be determined by comparing compressor current with condenser temperature using the graph shown in FIG. 6. The above process for determining the condenser temperature is described in assignee's commonly-owned U.S. patent application Ser. No. 11/059,646 filed on Feb. 16, 2005, the disclosure of which is herein incorporated by reference.

Once the condenser temperature is known, the processing circuitry 88 is then able to determine the subcooling of the refrigeration system 12 by subtracting the liquid-line temperature as indicated by the liquid-line temperature sensor 84 from the condenser temperature and then subtracting an additional small value (typically 2-3° F.) representing the pressure drop between an outlet of the compressor 10 and an outlet of the condenser 70. The processing circuitry 88 is therefore able to determine not only the condenser temperature but also the subcooling of the refrigeration system 12 without requiring an additional temperature sensor for either operating parameter.

The processing circuitry 88 is also able to calculate a temperature difference (TD) between the condenser 70 and the outdoor/ambient temperature surrounding the refrigeration system 12. The processing circuitry 88 is able to determine the condenser temperature by referencing either the power or current drawn by the compressor 10 against the graph shown in FIG. 6 without requiring a temperature sensor to be positioned within the condenser 70. Once the condenser temperature is known (i.e., derived), the processing circuitry 88 can determine the temperature difference (TD) by subtracting the ambient temperature as received from the outdoor/ambient temperature sensor 86 from the derived condenser temperature.

The discharge superheat of the refrigeration system 12 can also be determined once the condenser temperature is known. Specifically, the processing circuitry 88 can determine the discharge superheat of the refrigeration system 12 by subtracting the condenser temperature from the discharge-line temperature. As described above, the discharge-line temperature may be detected by the low-side sensor 82 and is provided to the processing circuitry 88. Because the processing circuitry 88 can determine the condenser temperature by referencing the compressor power against the graph shown in FIG. 6, and because the processing circuitry 88 knows the discharge-line temperature based on information received from the low-side sensor 82, the processing circuitry 88 can determine the discharge superheat of the compressor 10 by subtracting the condenser temperature from the discharge-line temperature.

As described above, the protection and control system 14 receives sensor data from the high-side sensor 80, low-side sensor 82, liquid-line temperature sensor 84, and outdoor/ambient temperature sensor 86, and derives non-measured operating parameters of the compressor 10 and/or refrigeration system 12 such as condenser temperature, subcooling of the refrigeration system 12, a temperature difference between the condenser 70 and outdoor/ambient temperature, and discharge superheat of the refrigeration system 12, without requiring individual sensors for each of the derived parameters. Therefore, the protection and control system 14 not only reduces the complexity of the compressor and refrigeration system, but also reduces costs associated with monitoring and diagnosing the compressor 10 and/or refrigeration system 12.

Once the processing circuitry 88 has received the sensor data and determined the non-measured operating parameters, the processing circuitry 88 can diagnose the compressor 10 and refrigeration system 12. As shown in FIGS. 4 and 5, the processing circuitry 88 is able to categorize a fault based on specific information received from the individual sensors and calculated non-measured operating parameters.

As shown in FIG. 4, once the processing circuitry 88 receives the sensor data and determines the non-measured operating parameters, the processing circuitry 88 can differentiate between specific low-side and high-side faults experienced by the compressor 10 and/or refrigeration system 12. Low-side faults may include a low charge condition, a low evaporator air flow condition, and/or a flow restriction at either or both of the condenser 70 and evaporator 72. A high-side fault may include a high-charge condition, a non-condensable condition (i.e., air in the refrigerant), and a low condenser air flow condition.

By way of example, the processing circuitry 88 may be able to determine that the compressor 10 and/or refrigeration system 12 is experiencing a low-charge condition if the discharge superheat of the refrigeration system 12 is increasing relative to a predetermined target stored within the processing circuitry 88 while both the subcooling and the condenser temperature difference (i.e., condensing temperature minus outdoor/ambient temperature) are decreasing relative to a predetermined target stored in the processing circuitry 88.

By way of another example, the processing circuitry 88 may be able to determine that the compressor 10 and/or refrigeration system 12 is experiencing a high-side fault such as a high charge condition if the subcooling of the refrigeration system 12 and the temperature difference (i.e., condensing temperature minus outdoor/ambient temperature) are each increasing relative to a predetermined target stored in the processing circuitry 88 while the discharge superheat of the refrigeration system 12 remains relatively unchanged relative to a predetermined target stored in the processing circuitry 88 for a thermal expansion valve/electronic expansion valve flow control system or decreases relative to a predetermined target stored in the processing circuitry 88 for an orifice flow control system.

Figure 16:
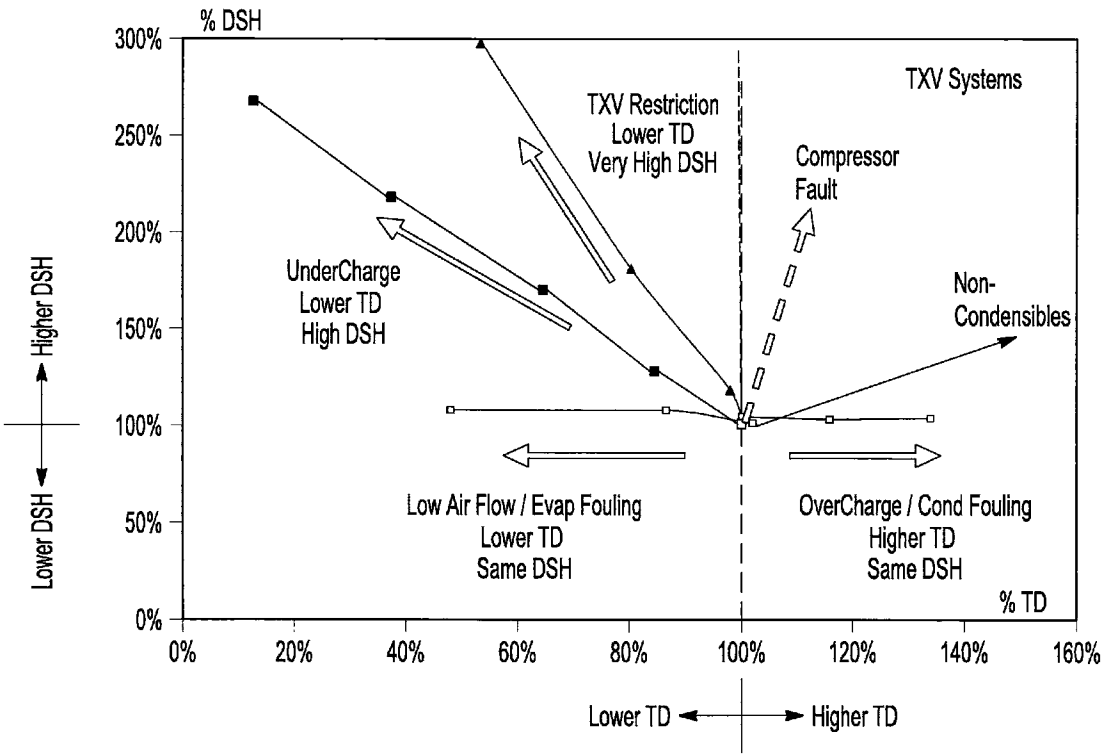
FIG. 16 is a graphical representation of various system and compressor faults based on condenser temperature difference and discharge superheat progressions.
Figure 17:
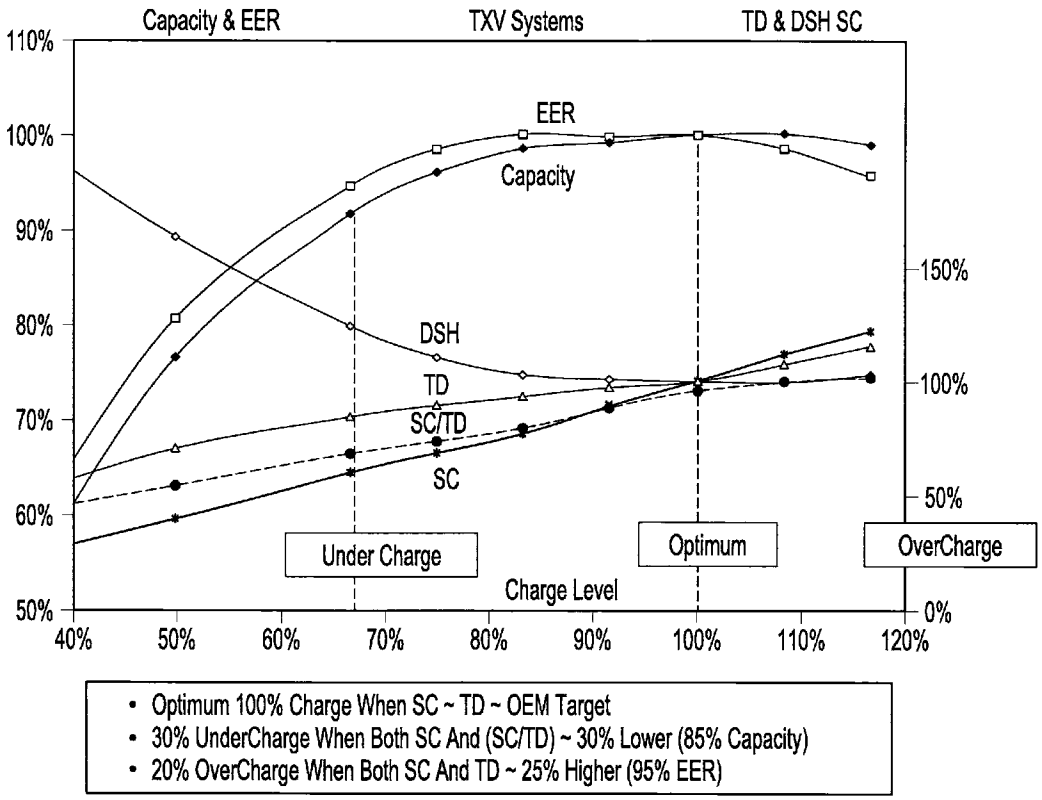
FIG. 17 is a graphical representation of subcooling, condenser temperature difference, discharge superheat, energy efficiency rating, and capacity for use in determining a charge level of a refrigeration system.
Figure 19:
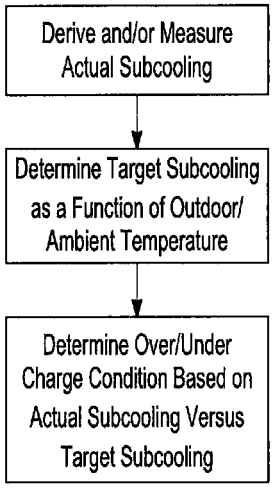
FIG. 19 is a flowchart illustrating a process for verifying a refrigerant charge of a refrigeration system.

High-efficiency systems tend to employ larger condenser coils, which tend to require less subcooling (i.e., less liquid in the condenser coil, in percentage, when compared to a smaller condenser coil) relative to the condenser temperature difference to deliver optimum charge, therefore both subcooling and condenser temperature difference can be used for a more precise charge verification. Therefore, the ratio of subcooling over condenser temperature difference may be used to check both subcooling and condenser temperature difference. This ratio may be pre-programmed as a target value in processing circuitry 88. The ratio of subcooling over condenser temperature difference is a function of efficiency and may be used to verify charge (FIGS. 16 and 17). For example, the efficiency for a standard refrigeration system may be 0.6, the efficiency for a mid-level refrigeration system may be 0.75, and the efficiency for a high-efficiency refrigeration system may be 0.9. Such target ratios may be programmed into the processing circuitry 88 to confirm proper operation of the refrigeration system (FIG. 19).

The various other low-side faults and high-side faults that may be determined by the processing circuitry 88 are shown in FIG. 4, where increasing parameters are identified by an upwardly pointing arrow, decreasing parameters are identified by a downwardly pointing arrow, and constant (i.e., unchanged) parameters are identified by a horizontal arrow.

While the protection and control system 14 is useful in diagnosing the compressor 10 and/or refrigeration system 12 by differentiating between various low-side faults and high-side faults during operation of the compressor 10 and refrigeration system 12, the protection and control system 14 may also be used during installation of the compressor 10 and/or refrigeration system 12. As noted in FIG. 4, the protection and control system 14 may be used to diagnose each of the low-side faults and high-side faults with the exception of a low condenser air-flow condition at installation. Such information is valuable during installation to ensure that the compressor 10 and respective components of the refrigeration system 12 are properly installed and functioning within acceptable limits.

As indicated in FIG. 4, each of the low-side faults are monitored by the protection and control system 14 on an on-going basis, while the only high-side fault monitored by the protection and control system 14 on an on-going basis is the low condenser-air-flow condition. The high-charge condition is typically not measured on an on-going basis by the protection and control system 14, as the charge of the system is generally set at installation. In other words, the charge of the refrigeration system 12 cannot be increased without physically supplying the system 12 with additional refrigerant. Therefore, the need for monitoring a high-charge condition after installation is generally unnecessary except when additional refrigerant is added to the refrigeration system 12. The protection and control system 14 does not typically monitor the non-condensable high-side fault on an on-going basis because air is not usually injected into the refrigerant once the refrigerant is added to the refrigeration system 12. Air is only added into the refrigeration system 12 when a supply of refrigerant used to charge the refrigeration system 12 is contaminated with air.

While monitoring the high-charge condition and non-condensibles condition are described as not being monitored on an on-going basis, each parameter may be monitored on an on-going basis by the protection and control system 14 to continually monitor the condition of the refrigerant disposed within the compressor 10 and/or refrigeration system 12.

Once the processing circuitry 88 has received the sensor data and has derived the non-measured operating parameters, the processing circuitry 88 can use the sensor data and non-measured operating parameters to derive performance data regarding operation of the compressor 10 and/or refrigeration system 12. With reference to FIG. 5, a flow chart is provided detailing how the processing circuitry 88 can derive a coil capacity of the evaporator 72 and an efficiency of the refrigeration system 12.

The processing circuitry 88 first receives sensor data from the high-side sensor 80, low-side sensor 82, liquid-line temperature sensor 84, and outdoor/ambient temperature sensor 86. Once the sensor data is received, the processing circuitry 88 uses the sensor data to derive the non-measured operating parameters such as subcooling of the refrigeration system 12, discharge superheat, and condenser temperature at 83.

The processing circuitry 88 can determine the condenser temperature by referencing an approximated evaporator temperature (i.e., at 45 degrees F., 50 degrees F., or 55 degrees F.) against the current drawn by the compressor, as previously described. A plot of current versus condenser temperature may be used to reference an approximated evaporator temperature against current information received from the high-side sensor 80 (FIG. 6). By using a plot as shown in FIG. 6, the processing circuitry 88 can determine the condenser temperature by referencing current information received from the high-side sensor 80 against the approximated evaporator temperature values to determine the condenser temperature.

Figure 7:
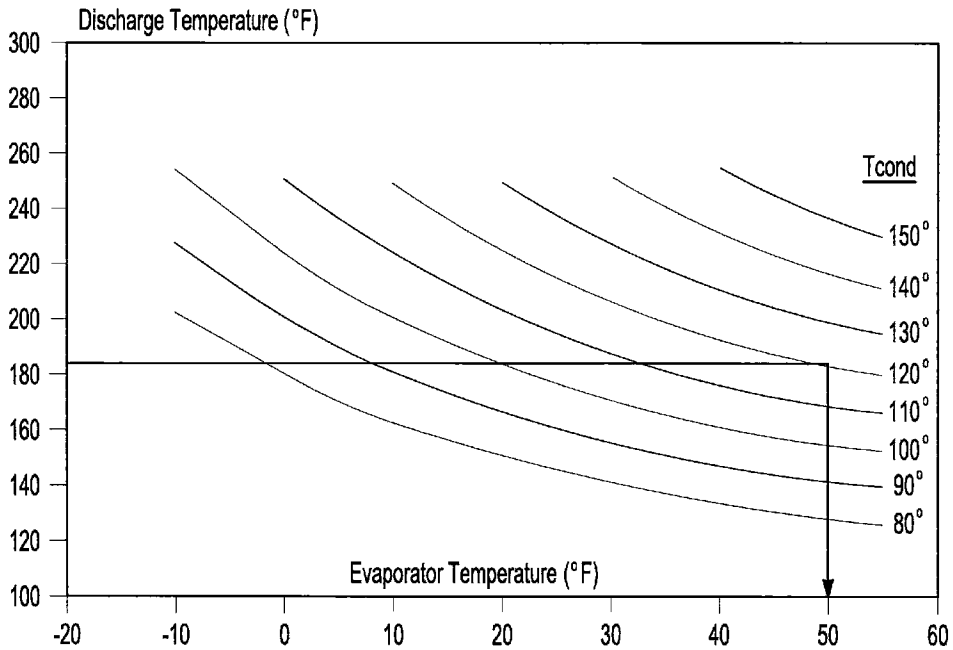
FIG. 7 is a graph of discharge temperature versus evaporator temperature for use in determining an evaporator temperature at a given condenser temperature.

Once the condenser temperature is determined, the processing circuitry 88 can then reference a plot as shown in FIG. 7 to determine the exact evaporator temperature based on discharge temperature information received from the low-side sensor 82. Once both the condenser temperature and the evaporator temperature are known, the processing circuitry 88 can then determine the compressor capacity and flow.

Figure 8:
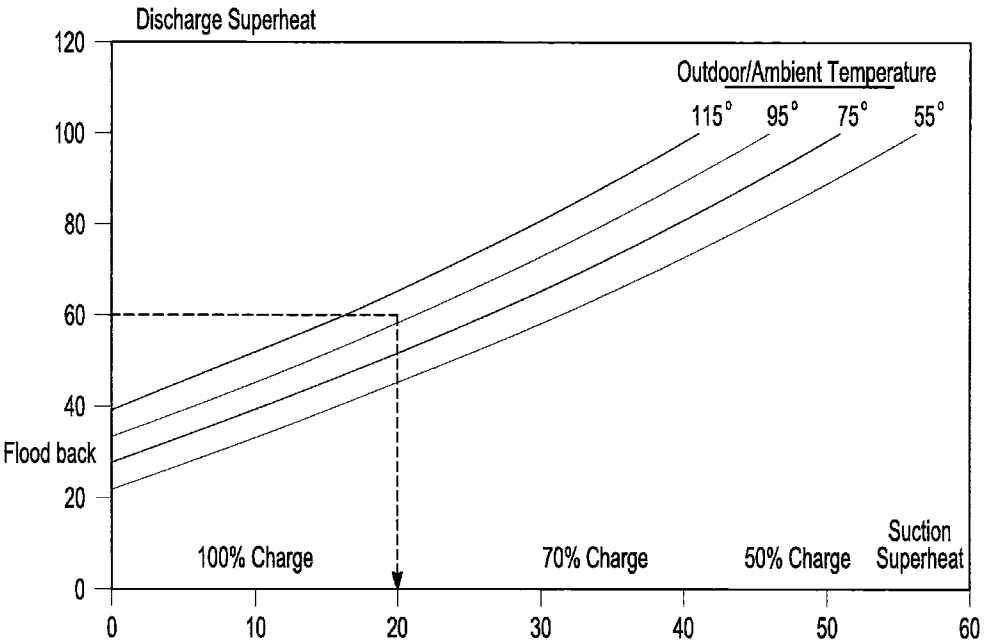
FIG. 8 is a graph of discharge superheat versus suction superheat to determine suction superheat at a given outdoor/ambient temperature.

The discharge superheat may be determined by subtracting the condenser temperature from the discharge-line temperature, as indicated by the low-side sensor 82. Once the discharge superheat is determined, the processing circuitry 88 can determine the suction superheat by referencing a plot as shown in FIG. 8. Specifically, the suction superheat may be determined by referencing the discharge superheat against the ambient temperature as indicated by the outdoor/ambient temperature sensor 86.

In addition to deriving the condenser temperature, evaporator temperature, subcooling, discharge superheat, compressor capacity and flow, and suction superheat, the processing circuitry 88 may also measure or estimate the fan power of the condenser fan 76 and/or evaporator fan 78 and derive a compressor power factor for use in determining the efficiency of the refrigeration system 12 and the capacity of the evaporator 72. The fan power of the condenser fan 76 and/or evaporator fan 78 may be directly measured by sensors 85 associated with the fans 76, 78 or may be estimated by the processing circuitry 88.

Once the non-measured operating parameters are determined, the performance of the compressor 10 and refrigeration system 12 can be determined at 87. The processing circuitry 88 uses compressor capacity and flow and suction superheat to determine a coil capacity of the evaporator 72 at 89. Because the processing circuitry 88 uses the fan power of the condenser fan 76 and/or evaporator fan 78 in determining the capacity of the evaporator 72, the processing circuitry 88 is able to adjust the capacity of the evaporator 72 based on an estimated heat of the condenser fan 76 and/or evaporator fan 78. In addition, because the compressor capacity and flow is determined using the suction superheat, the capacity of the evaporator 72 may also be adjusted based on suction-line heat gain.

Once the capacity of the evaporator 72 is determined, the efficiency of the refrigeration system 12 can be determined using the capacity of the evaporator 72 along with the fan power and compressor power factor at 91. Specifically, the processing circuitry 88 divides the capacity of the evaporator 72 by the sum of the compressor power and fan power. Dividing the capacity of the evaporator 72 by the sum of the fan power and compressor power provides an indication of the energy efficiency of the refrigeration system 12.

Figure 9:
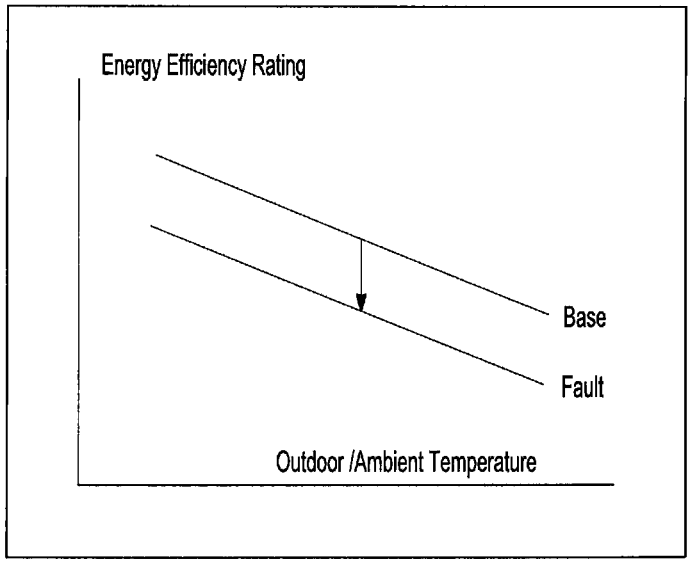
FIG. 9 is a graph of energy efficiency versus outdoor/ambient temperature for use in diagnosing a compressor and/or refrigeration system.
Figure 10:
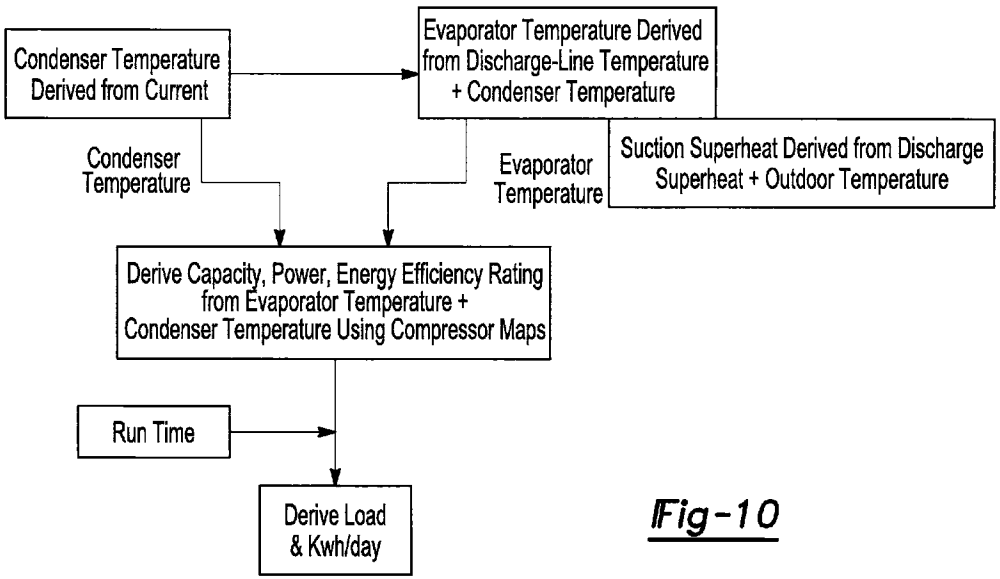
FIG. 10 is a flowchart illustrating a procedure used to determine system load and energy consumption of a refrigeration system.

The energy efficiency of the refrigeration system 12 may be used to diagnose the compressor 10 and/or refrigeration system 12 by plotting the determined energy efficiency rating for the refrigeration system 12 against a base energy efficiency rating to determine a fault condition (FIG. 9). If the determined energy efficiency rating of the refrigeration system 12 deviates from the base energy efficiency rating, the processing circuitry 88 can determine that the refrigeration system 12 is operating outside of predetermined limits. Because operation of the refrigeration system 12 varies with changing outdoor/ambient temperatures, the energy efficiency rating is plotted against the outdoor/ambient temperature to account for changes in the outdoor/ambient temperature and its affect on the refrigeration system 12.

Figure 12:
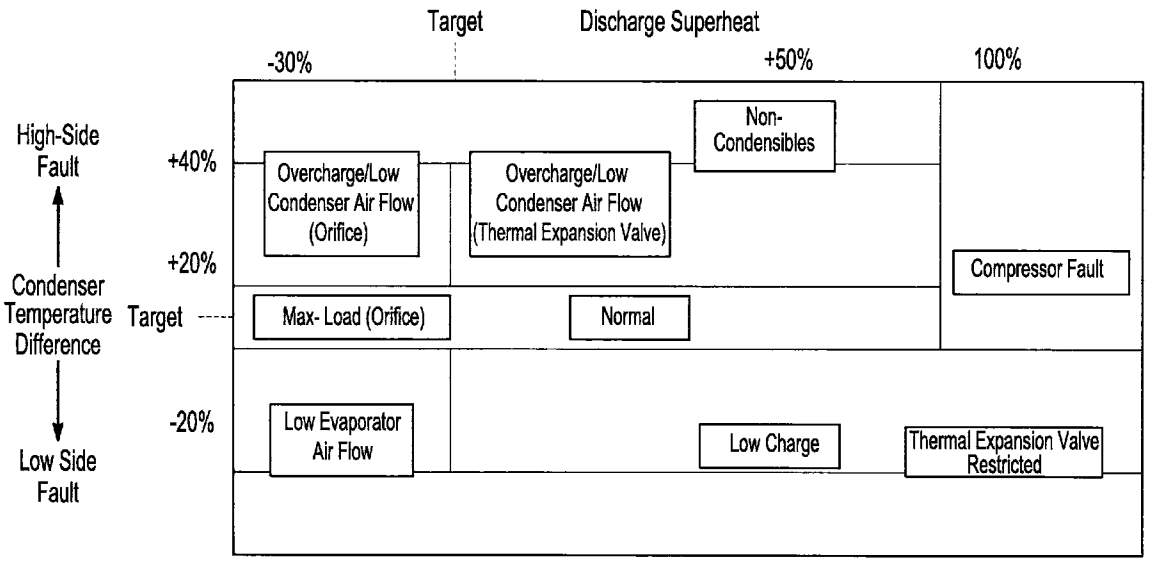
FIG. 12 is a graph depicting specific fault conditions at various discharge superheat conditions.

In addition to driving the energy efficiency of the refrigeration system 12, the processing circuitry 88 can also determine the load experienced by the refrigeration system 12 (i.e., kilowatt hours per day). As shown in FIG. 12, the processing circuitry 88 can determine the house load based on the capacity of the evaporator 72 and the run time of the compressor 10 (i.e., BTU per hour multiplied by run time (in hours) equals BTU load). This information, in combination with the run time of the compressor 10, may be used by the processing circuitry 88 to determine the overall load of the refrigeration system 12, and can be used by the processing circuitry 88 to diagnose the compressor 10 and/or refrigeration system 12.

Figure 18:
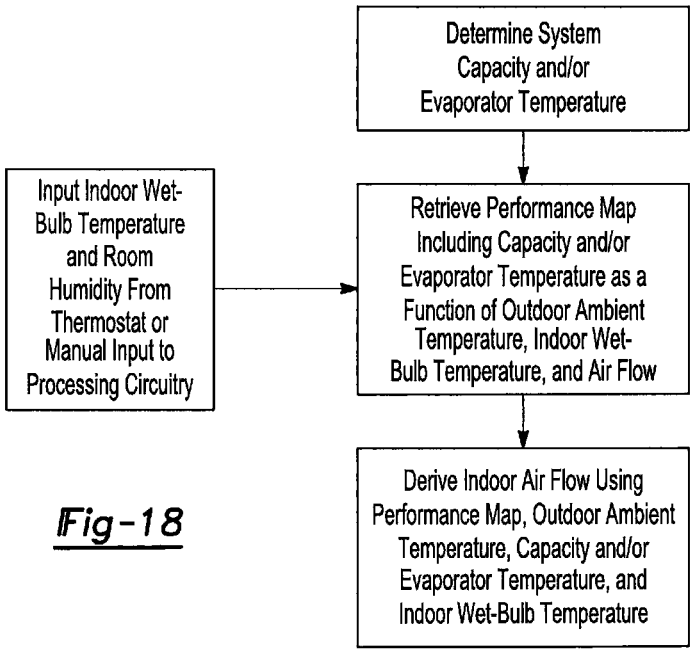
FIG. 18 is a flowchart illustrating a process for verifying air flow through an evaporator.

Once the capacity is derived, the processing circuitry 88 may then also derive the evaporator air flow (i.e., air flow through the evaporator 72) as shown in FIG. 18 based on a pre-determined table located in non-volatile memory of the processing circuitry 88. The processing circuitry 88 relates the capacity or evaporator temperature to air flow as a function of outdoor ambient and indoor room dry-bulb and wet-bulb temperatures (i.e., humidity).

Specifically, the processing circuitry 88 may receive the outdoor temperature from the outdoor temperature sensor 86 and may receive the wet-bulb and/or room humidity from a thermostat. The thermostat may communicate the wet-bulb temperature and/or room humidity to the processing circuitry 88 through digital serial communication. Alternatively, the wet-bulb temperature and room humidity can be manually input by a user. Once the outdoor ambient temperature and indoor wet-bulb temperatures are known, the processing circuitry 88 can reference the outdoor temperature and wet-bulb temperature on a performance map stored in the processing circuitry 88 to determine the air flow through the evaporator 72. The performance map may include pre-programmed capacity and/or evaporator temperature information as it relates to outdoor ambient temperature, wet-bulb temperature, and air flow. Verifying evaporator air flow may be used to confirm proper installation and system capacity.

As described, the protection and control system 14 uses the various sensor data and derived non-measured operating parameters to monitor and diagnose operation of the compressor 10 and/or refrigeration system 12. The sensor data received from the high-side sensor 80, low-side sensor 82, liquid-line temperature sensor 84, and outdoor/ambient temperature sensor 86 may be used by the processing circuitry 88 to differentiate between various fault areas to diagnose the compressor 10 and/or refrigeration system 12. FIG. 11 details various fault areas and diagnostics that the processing circuitry 88 can differentiate between based on sensor data received from the high-side sensor 80, low-side sensor 82, liquid-line temperature sensor 84, and outdoor/ambient temperature sensor 86.

For example, the processing circuitry 88 relies on information from the high-side sensor 80 and low-side sensor 82 to determine compressor faults such as a locked rotor, a motor failure, or insufficient pumping, while the processing circuitry 88 relies on information from the high-side sensor 80, low-side sensor 82, and liquid-line temperature sensor 84 to distinguish between high-side system faults such as cycling on protection (i.e., cycling under a tripped condition), low air-flow through the condenser 70, and an overcharged condition.

FIG. 12 further illustrates how the processing circuitry 88 is able to distinguish between high-side faults and low-side faults using discharge superheat. As described above, the discharge superheat is a derived parameter and is calculated based on information received from the high-side sensor 80 and low-side sensor 82. The processing circuitry 88 compares the discharge superheat with the condenser temperature difference to differentiate between various high-side faults such as an overcharged condition or a non-condensable condition and various low-side faults such as low air-flow through the evaporator 72 or a low-charge condition. The processing circuitry 88 is not only able to derive non-measured operating parameters, but is also able to use the non-measured operating parameters and the sensor data to diagnose the compressor 10 and refrigeration system 12.

Receiving sensor data and deriving non-measured operating parameters allows the protection and control system 14 to monitor and diagnose the compressor 10 and refrigeration system 12 during operation. In addition to diagnosing the compressor 10 and refrigeration system 12 during operation, the protection and control system 14 can also use the sensor data and the non-measured operating parameters during installation of the compressor and individual components of the refrigeration system 12 (i.e., condenser 70, evaporator 72, and expansion device 74) to ensure that the compressor 10 and individual components of the refrigeration system 12 are properly installed.

Figure 13:
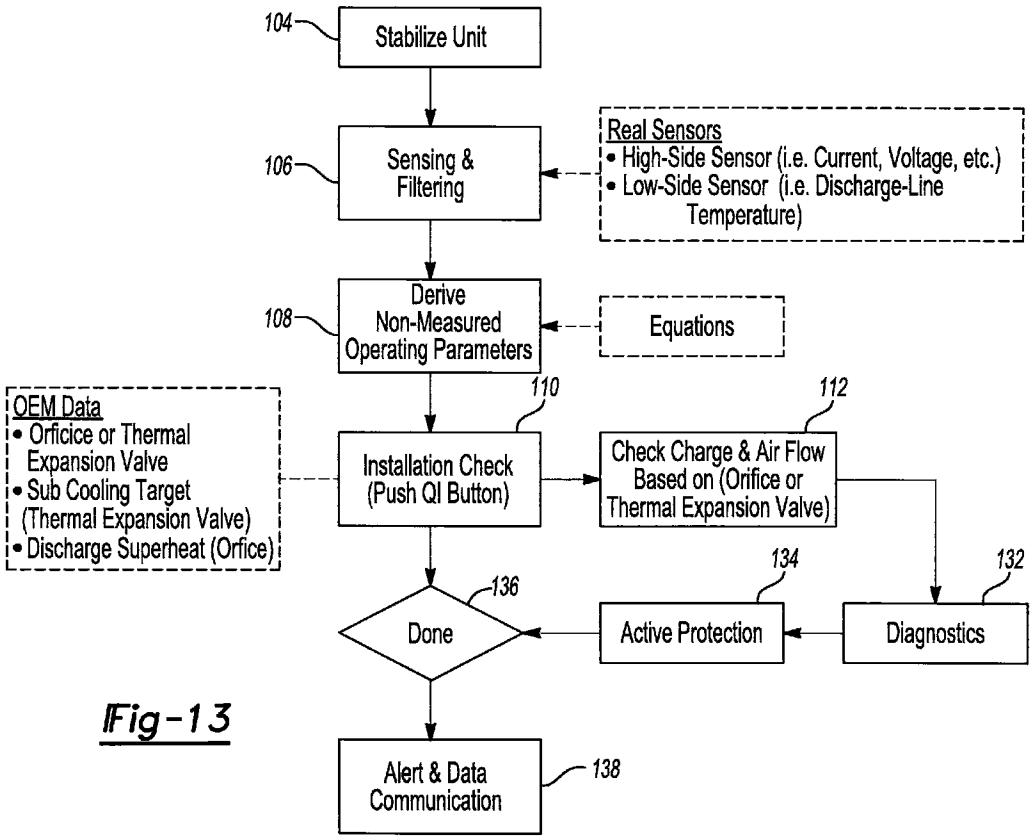
FIG. 13 is a flowchart depicting a process for installing and diagnosing a compressor and/or refrigeration system.

With reference to FIG. 13, an exemplary flow chart is provided detailing an installation check used by the protection and control system 14 during installation of the compressor 10 and/or components of the refrigeration system 12. Once the compressor 10 is installed into the refrigeration system 12, the compressor 10 is stabilized at 104. Once the compressor 10 is stabilized, the processing circuitry 88 receives sensor data from the high-side sensor 80, low-side sensor 82, liquid-line temperature sensor 84, and outdoor/ambient temperature sensor 86 at 106. As described above, the processing circuitry 88 uses the sensor data from the high-side sensor 80, low-side sensor 82, liquid-line temperature sensor 84, and outdoor/ambient temperature sensor 86 to derive non-measured operating parameters at 108. The non-measured operating parameters include, but are not limited to, condenser temperature, subcooling of the refrigeration system 12, condenser temperature difference (i.e., condenser temperature minus outdoor/ambient temperature), and discharge superheat of the refrigeration system 12. This information is used at an installation check 110 to determine whether the compressor 10 and various components of the refrigeration system 12 are property installed.

Original equipment manufacturing data (OEM Data) such as size, type, condenser coil pressure drop, compressor maps, and/or subcooling targets for refrigeration system components such as the expansion device 74 are input into the processing circuitry 88 to assist with the installation check 110. For example, tables of capacity as a function of indoor air flow (i.e., air flow through the evaporator 72) and indoor and outdoor temperatures may also be pre-programmed into the processing circuitry 88. The processing circuitry 88 can use this information, for example, to adjust a subcooling calculation made by reading a pressure at an outlet of the condenser 73 to account for a pressure drop through the condenser 73. This information is used by the processing circuitry 88 to determine whether the components of the refrigeration system 12 are operating within predetermined limits.

Figure 14:
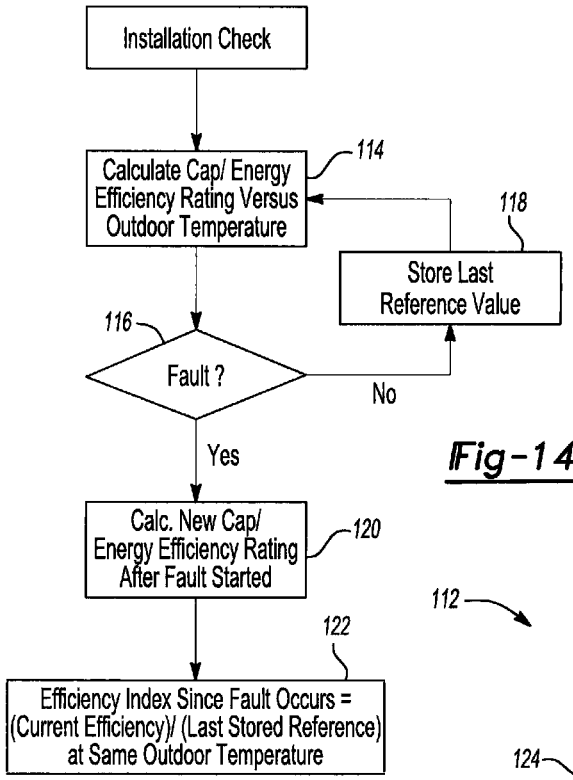
FIG. 14 is a flowchart depicting a compressor installation process.

With reference to FIG. 14, the processing circuitry 88 first calculates the energy efficiency rating of the refrigeration system 12 and plots the energy efficiency rating versus the outdoor/ambient temperature as provided by the outdoor/ambient temperature sensor 86 at 114. The processing circuitry 88 compares the calculated energy efficiency rating versus a base energy efficiency rating (FIG. 9) to determine if a fault exists at 116. If the energy efficiency rating is within an acceptable range such that the energy efficiency rating is sufficiently close to the base efficiency rating, the processing circuitry stores the value of the energy efficiency rating at 118. If the processing circuitry 88 determines a fault condition exists, the processing circuitry 88 calculates a new energy efficiency rating after the fault started at 120.

The processing circuitry 88 is able to track the energy efficiency of the refrigeration system 12 by generating an efficiency index at 122. The processing circuitry 88 generates the efficiency index by dividing the current efficiency by the last stored reference at the same outdoor/ambient temperature. This way, the processing circuitry 88 is able to track the change in efficiency of the refrigeration system 12 over time at the same outdoor/ambient temperature.

Figure 15:
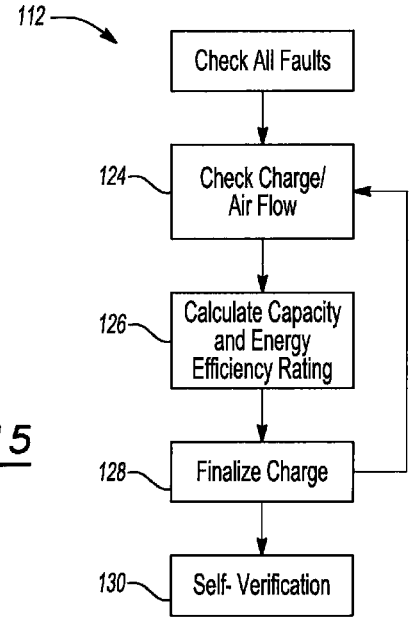
FIG. 15 is a flowchart depicting a compressor installation and refrigerant-charge process.

Once the installation check 110 is complete, the protection and control system 14 then determines the refrigerant charge within the refrigeration system 12, as well as the air flow through the condenser 70 and evaporator 72. With reference to FIG. 15, a flowchart detailing a process for determining the refrigerant charge is provided. The processing circuitry 88 first determines the initial charge within the refrigeration system 12 and the air flow through the condenser 70 and evaporator 72 at 124. Once the initial charge and air flow are determined, the processing circuitry 88 then calculates the capacity and energy efficiency rating of the refrigeration system 12 at 126.

The capacity and energy efficiency rating are compared to baseline values to determine whether the refrigeration system 12 contains a predetermined amount of refrigerant. If the capacity and/or energy efficiency rating indicates that the refrigeration system 12 is either undercharged or overcharged, the processing circuitry 88 indicates that either more charge or less charge is required at 128. Once the capacity and energy efficiency rating indicate that the refrigeration system 12 is properly charged, the level of refrigerant and airflow through the condenser 70 and evaporator 72 is verified by the processing circuitry 88 at 130.

Once the compressor 10 and components of the refrigeration system 12 are properly installed and the charge and air flow are verified, the protection and control system 14 is able to diagnose the compressor 10 and/or refrigeration system 12 at 132. The protection and control system 14 ensues active protection of the compressor 10 and/or refrigeration system 12 at 134, indicating that the installation is complete at 136. During operation of the compressor 10 and refrigeration system 12, the protection and control system 14 provides alerts and data at 138 indicative of operation of the compressor 10 and/or refrigeration system 12.

The protection and control system 14 is able to receive sensor data and determine non-measured operating parameters of a compressor and/or refrigeration system to reduce the overall number of sensors required to adequately protect and diagnose the compressor and/or refrigeration system. In so doing, the protection and control system 14 reduces costs associated with monitoring and diagnosing a compressor and/or a refrigeration system and simplifies such monitoring and diagnostics by driving virtual sensor data from a limited number of sensors.

What is claimed is:

1. A system comprising:

a compressor operable in a refrigeration circuit and including a motor;

a sensor producing a signal indicative of one of current and power drawn by said motor;

an ambient temperature sensor producing a signal indicative of an ambient temperature;

a liquid-line temperature sensor providing a signal indicative of a temperature of liquid circulating within said refrigeration circuit; and processing circuitry processing said current or power signal to determine a condenser temperature of said refrigeration circuit and a subcooling value of said refrigeration circuit from said condenser temperature and said liquid-line temperature signal, said processing circuitry processing said current or power signal and said ambient temperature signal to determine a difference between said condenser temperature and said ambient temperature, said processing circuitry determining a system operating condition based on said subcooling value and said difference between said condenser temperature and said ambient temperature.

2. The system of claim 1, further comprising a compressor map stored in said processing circuitry for determining said condenser temperature.

3. The system of claim 1, wherein said processing circuitry determines an efficiency of said refrigeration circuit based on a ratio of said subcooling value and said condenser temperature difference.

4. The system of claim 1, wherein said refrigeration circuit includes an evaporator, said processing circuitry determining a house load based on a capacity of said evaporator and a run time of said compressor.

5. The system of claim 4, wherein said processing circuitry determines an overall load of said refrigeration circuit based on said house load and said run time of said compressor.

6. The system of claim 4, wherein said processing circuitry determines air flow through said evaporator based on one of a temperature of said evaporator or said capacity of said evaporator.

7. The system of claim 6, wherein said processing circuitry references said capacity on a predetermined table stored within said processing circuitry to determine said air flow through said evaporator.

8. The system of claim 7, wherein said processing circuitry relates said capacity to said air flow as a function of outdoor ambient temperature and indoor room dry-bulb and wet-bulb temperatures.

9. The system of claim 6, wherein said processing circuitry references a temperature of said evaporator on a predetermined table stored within said processing circuitry to determine said air flow through said evaporator.

10. The system of claim 9, wherein said processing circuitry relates a temperature of said evaporator to said air flow as a function of outdoor ambient temperature and indoor room dry-bulb and wet-bulb temperatures.

11. The system of claim 1, wherein said condenser temperature is a saturated condenser temperature corresponding to high-side pressure.

12. The system of claim 1, wherein said subcooling is determined by subtracting said liquid-line temperature signal from said condenser temperature.

13. The system of claim 1, further comprising a discharge-line temperature sensor producing a signal indicative of a temperature at a discharge of said compressor.

14. The system of claim 13, wherein said processing circuitry determines a discharge superheat by subtracting said condenser temperature from said discharge-line temperature signal.

15. The system of claim 13, wherein said processing circuitry determines said system operating condition is a low-side fault of at least one of said compressor and said refrigeration circuit based on said condenser temperature difference decreasing in combination with a state of said subcooling value and a state of said discharge superheat.

16. The system of claim 15, wherein said low side fault is at least one of a low charge condition, a low evaporator air flow condition, and a flow restriction.

17. The system of claim 15, wherein said state of said subcooling value is indicative of whether said subcooling value is increasing, unchanged, or decreasing and said state of said discharge superheat is indicative of whether said discharge superheat is increasing, unchanged, or decreasing.

18. The system of claim 13, wherein said processing circuitry determines said system operating condition is a high-side fault of at least one of said compressor and said refrigeration circuit based on said condenser temperature difference increasing in combination with a state of said subcooling value and a state of said discharge superheat.

19. The system of claim 18, wherein said high-side fault is at least one of a high charge condition, a non-condensibles condition, and a low condenser air flow.

20. The system of claim 18, wherein said state of said subcooling value is indicative of whether said subcooling value is increasing, unchanged, or decreasing and said state of said discharge superheat is indicative of whether said discharge superheat is increasing, unchanged, or decreasing.

21. The system of claim 1, wherein said liquid-line temperature sensor is disposed proximate to an outlet of a condenser of said refrigeration circuit and said signal is indicative of a temperature of said fluid exiting said condenser in a subcooled state.

22. The system of claim 1, wherein said system operating condition is a system charge level.

* * * * *

UNITED STATES PATENT AND TRADEMARK OFFICE

CERTIFICATE OF CORRECTION

PATENT NO. : 8,590,325 B2
APPLICATION NO. : 11/776879
DATED : November 26, 2013
INVENTOR(S) : Hung M. Pham It is certified that error appears in the above-identified patent and that said Letters Patent is hereby corrected as shown below:

On the title page, item 56

| | |
|---|---|
| Page 6, Column 1, Other Publications, Lines 3-4 | Delete "PCT/US2008/012364" and insert --PCT/US2008/012364,--. |
| Page 6, Column 1, Other Publications, Line 6 | Delete "PCT/US2008/012364" and insert --PCT/US2008/012364,--. |
| Page 6, Column 1, Other Publications, Line 8 | Delete "PCT/US2007/019563" and insert --PCT/US2007/019563,--. |

Signed and Sealed this
Twenty-first Day of July, 2015

Michelle K. Lee

Michelle K. Lee
*Director of the United States Patent and Trademark Office*